US005974925A

United States Patent [19]

Lindee et al.

[11] Patent Number: 5,974,925

[45] Date of Patent: Nov. 2, 1999

[54] CONTINUOUS FEED FOR FOOD LOAF SLICING MACHINE

[75] Inventors: Scott A. Lindee, New Lenox; David M. Hansen, Orland Park, both of Ill.

[73] Assignee: Formax, Inc., Mokena, Ill.

[21] Appl. No.: 08/527,071

[22] Filed: Sep. 13, 1995

Related U.S. Application Data

[63] Continuation-in-part of application No. 08/320,752, Oct. 11, 1994, Pat. No. 5,649,463.

[51] Int. Cl.[6] ..... B26D 7/06

[52] U.S. Cl. ..... 83/412; 83/403.1; 83/409.1; 83/859; 83/932

[58] Field of Search ..... 83/355, 444, 403.1, 83/409.1, 409.2, 412, 416, 422, 437.1, 932, 859, 591

[56] References Cited

U.S. PATENT DOCUMENTS

| | | | |
|---|---|---|---|
| 2,833,349 | 5/1958 | Green | 83/699.31 |
| 3,162,226 | 12/1964 | Toby et al. . | |
| 3,244,044 | 4/1966 | Lohmeyer, Jr. et al. | 83/422 |
| 3,306,147 | 2/1967 | Goodman, Jr. et al. | 83/422 |
| 3,318,351 | 5/1967 | Werder . | |
| 3,322,174 | 5/1967 | Tenwolde . | |
| 3,358,724 | 12/1967 | Toby . | |
| 3,821,913 | 7/1974 | Bajcar et al. . | |
| 3,827,319 | 8/1974 | Flesch . | |
| 3,894,457 | 7/1975 | Miller et al. | 83/27 |
| 4,015,494 | 4/1977 | Spooner et al. | 83/403.1 |
| 4,239,445 | 12/1980 | Ozawa | 83/416 X |
| 4,428,263 | 1/1984 | Lindee et al. . | |
| 4,577,539 | 3/1986 | Bonacci | 83/437.1 X |
| 4,760,765 | 8/1988 | Nishimoto et al. . | |
| 4,768,325 | 9/1988 | Lindee et al. | 53/122 |
| 4,913,019 | 4/1990 | Hayashi . | |
| 4,934,232 | 6/1990 | Weber et al. | 83/355 |
| 5,079,982 | 1/1992 | Antonissen | 83/422 |
| 5,186,090 | 2/1993 | Bunch, Jr. | 83/412 X |
| 5,207,139 | 5/1993 | Orphanos et al. | 83/444 X |
| 5,267,168 | 11/1993 | Antonissen et al. | 83/932 |
| 5,320,014 | 6/1994 | Skaar et al. . | |
| 5,343,790 | 9/1994 | Kuhrt | 83/444 X |
| 5,394,793 | 3/1995 | Julian et al. | 83/932 X |
| 5,566,600 | 10/1996 | Johnson et al. | 83/77 |

FOREIGN PATENT DOCUMENTS

| | | | |
|---|---|---|---|
| 2851683 | 6/1979 | Germany | 83/422 |
| 4235985 | 4/1994 | Germany | 83/663 |

*Primary Examiner*—Rinaldi I. Rada
*Assistant Examiner*—Charles Goodman
*Attorney, Agent, or Firm*—Dorn, McEachran, Jambor & Keating

[57] ABSTRACT

A high speed slicing machine feeds two or more food loaves continuously along parallel loaf paths through an orifice member into a slicing station for slicing by one cyclically driven knife blade; the slices are stacked or shingled in groups on a receiving conveyor below the slicing station. There are two independent loaf feed drives; slices from one loaf may be thicker than slices from the others. Each loaf feed drive advances at least one loaf into the slicing station, partly by gravity and partly by a positive loaf feed drive. Each positive loaf feed drive comprises a pair of angularly converging "short" conveyors; adjustments and bias are provided for each set of "short" conveyors. In the slicing station, an arcuate blade is rotated along a closed cutting path that intersects the ends of food loaves fed into the slicing station. A conveyor system discharges groups of food loaf slices after they are weighed.

10 Claims, 16 Drawing Sheets

1122
1106
1001
1104
1109
1113
1109
1116
1120
1121
1124
1108
4
R
1107
1111
1125
1165
1122
149
1101
1102
66
1112
D
P
Q
1163
1145
4
E
1161
(HORIZONTAL)
6
6
1122

CONTINUOUS FEED FOR FOOD LOAF SLICING MACHINE

This patent application is a continuation-in-part of application Ser. No. 08/320,752 filed Oct. 11, 1994 now U.S. Pat. No. 5,649,463, a Notice of Allowability was issued Jan. 16, 1997. Three other U.S. patent applications, Ser. Nos. 08/320,750 (now abandoned), 08/320,749, now U.S. Pat. No. 5,566,600 issued Oct. 22, 1996, and 08/320,759, allowed Sep. 11, 1996, (now pending), relate to the slicing machine disclosed herein. All are assigned to the same assignee as the present invention; all were filed Oct. 11, 1994.

BACKGROUND OF THE INVENTION

There are many different kinds of food loaves; they come in a wide variety of shapes and sizes. Meat loaves are made from various different meats, including ham, pork, beef, lamb, turkey, fish, and others. The meat may be in large pieces or may be thoroughly comminuted. Meat loaves come in different shapes (round, square, rectangular, oval, etc.) and in different lengths, up to six feet (180 cm) or even longer. The cross-sectional sizes of the loaves can be quite different; the maximum transverse dimension may be as small as one and one-half inches (four cm) or as large as ten inches (twenty-five cm). Loaves of cheese or other foods come in the same ranges as to composition, shape, length, and transverse size.

Many food loaves meet a common fate; they are sliced, the slices are grouped in accordance with a particular weight requirement and then packaged and sold. The number of slices in a group may vary, depending on the size and consistency of the food loaf and on the desires of the producer, the wholesaler, or the retailer. For some products, neatly aligned stacked slice groups are preferred. For others, slice groups should be shingled so that a purchaser can see a part of every slice. For bacon or other food products of variable shape, the problems do not just increase; they literally multiply.

There are a variety of different known slicing machines for food loaves. They range from small, manually fed slicers used in butcher shops to large, high speed slicers usually employed in meat processing plants. The present invention is directed to a continuous food loaf feed mechanism for a high speed slicing machine of the kind used in a meat processing plant.

Some known high speed food loaf slicing machines have sliced two food loaves simultaneously with a single, cyclically driven knife blade. Other prior high speed slicing machines, including that shown in S. Lindee et al. U.S. Pat. No. 4,428,263, slice one loaf at a time, but could be expanded to slice two or more loaves simultaneously. None of the prior high speed slicing machines have had the versatility needed to slice food loaves of the many different sizes and shapes referred to above, particularly with provision for either stacking or shingling of the sliced output, variations in slice thickness from two or more different loaves, and precision control of the weight of slice groups.

SUMMARY OF THE INVENTION

It is a principal object of the present invention to provide a new and improved continuous food loaf feed mechanism for a versatile high speed slicing machine capable of slicing two, three, or more food loaves with a single cyclically driven knife blade with accommodation for food loaves that vary widely in dimensions, a machine that can vary the slice thickness for groups of slices cut simultaneously from different loaves.

Another object of the invention is to provide a new and improved continuous food loaf feed mechanism for a versatile high speed slicing machine incorporating self-correcting precision control, preferably with internal computer control, so that the slicing machine output is adapted to a broad range of end use requirements.

A specific object of the invention is to provide a new and improved continuous food loaf feed mechanism for a high speed slicing machine that is adjustable to accommodate a broad range of loaf sizes, that maintains a controlled clamping force on the food loaves entering the slicing station, and that provides both forward and reverse movements along its loaf path.

Another specific object of the invention is to provide a food loaf orifice member, at the entrance to the slicing station, that holds each loaf in accurate alignment regardless of loaf size variations.

Accordingly the invention relates to an improvement for a continuous loaf feed mechanism for a high speed food loaf slicing machine. The slicing machine includes a slicing station comprising a knife blade and a knife blade drive driving the blade along an arcuate cutting path, and an inclined loaf support supporting a food loaf for movement by gravity along a loaf path intersecting the cutting path. There are two short loaf feed conveyors, the short conveyors being spaced from each other and engaging opposite sides of the food loaf immediately ahead of the cutting path; variable speed conveyor drive means drive the two short conveyors at variable speeds to vary the thickness of slices cut from the loaf. The improvement, in one aspect, comprises the two short conveyors converging toward each other in the direction of the loaf path so that the food loaf is most firmly engaged by the conveyors immediately ahead of the cutting path. Another aspect of the improvement comprises retraction means for retracting the short conveyors, the housing for those conveyors, and any food loaves engaged between those conveyors during non-cutting operations.

A sub-combination employed in the invention comprises an orifice member which comprises a block of machinable plastic having an orifice therethrough through which a food loaf advances in a given loaf feed direction into the cutting path of a cyclically operable knife blade; the internal surface of the orifice conforms to the cross-sectional size and shape of the food loaf, and the internal surface of the orifice has a dual taper which reduces the orifice size in the loaf feed direction.

BRIEF DESCRIPTION OF THE DRAWINGS

In the Drawings:

FIG. 9A shows some of the components of FIG. 9 in an alternate position used for relatively short food loaves;

Figure 1:
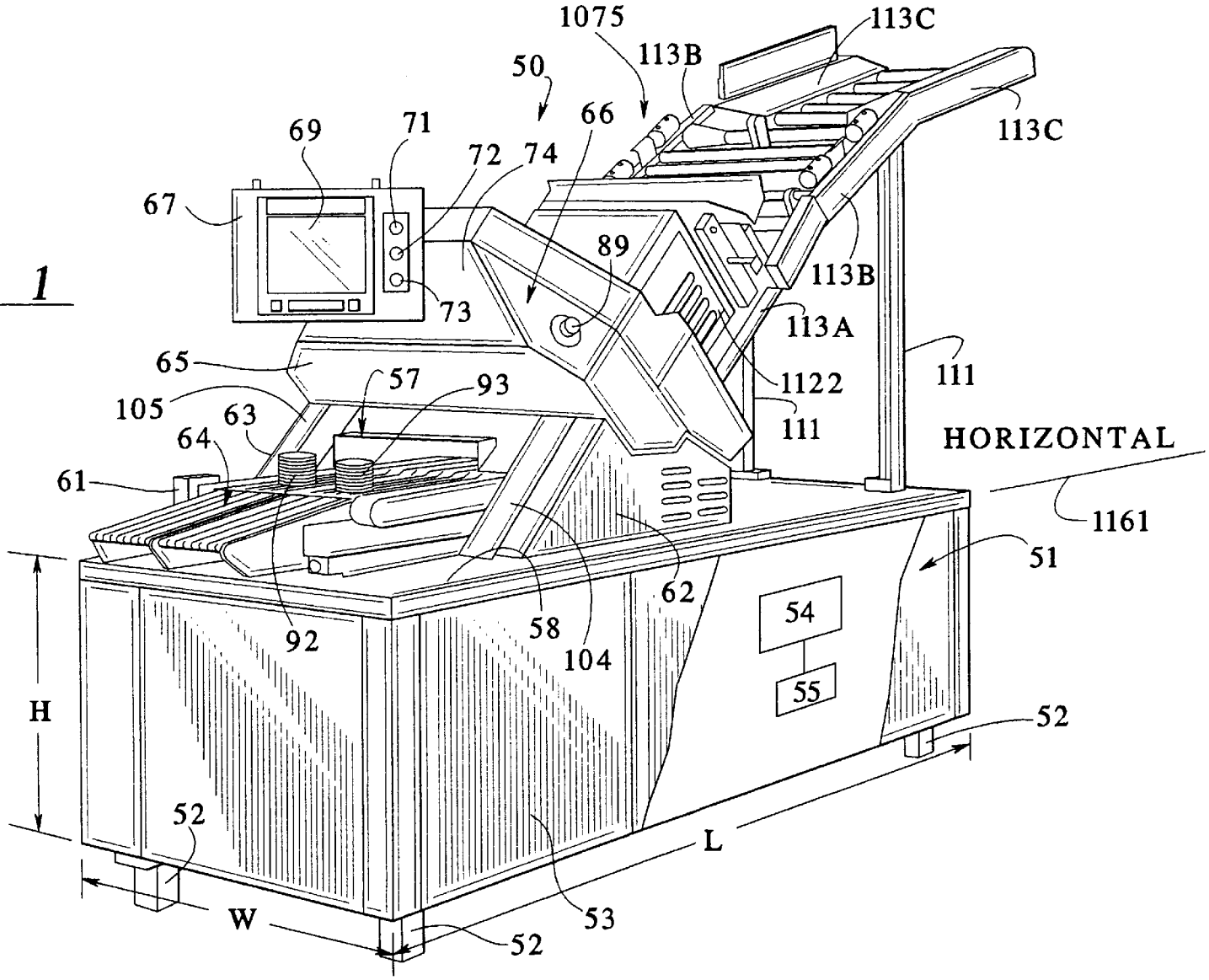
FIG. 1 is a perspective view of a food loaf slicing machine incorporating a continuous food loaf feed mechanism constructed in accordance with a preferred embodiment of the invention.

In many of the drawings subsequent to FIG. 1 components have been rotated 45° (see angle E in FIG. 2) to fit them onto their sheets. A horizontal orientation line is included in the drawings where appropriate.

DESCRIPTION OF THE PREFERRED EMBODIMENTS

The Basic Slicing Machine, FIG. 1

FIG. 1 illustrates a food loaf slicing machine 50 which includes a continuous loaf feed mechanism constructed in accordance with a preferred embodiment of the present invention. Slicing machine 50 comprises a base 51 which, in a typical machine, may have an overall height H of approximately thirty-two inches (eighty-one cm), an overall length L of about one hundred three inches (two hundred sixty-two cm), and a width W of approximately forty-one inches (one hundred-four cm). Base 51 is mounted upon four fixed pedestals or feet 52 (three of the feet 52 appear in FIG. 1) and has a housing or enclosure 53 surmounted by a top 58. The base top 58 is preferably levelled; the line 1161 indicates the horizontal in FIG. 1. Base 51 typically affords an enclosure for a computer, low and high voltage electrical supplies, and a scale mechanism. Base enclosure 53 may also include a pneumatic supply or a hydraulic supply, or both.

Slicing machine 50, as seen in FIG. 1, includes an output conveyor drive 61 utilized to drive an output conveyor/classifier system 64. There is a front side guard 62 extending upwardly from the top 58 of base 51 at the near side of the slicing machine 50 as illustrated in FIG. 1. There is a similar front side guard 63 at the opposite side of machine 50. The two side guards 62 and 63 extend upwardly from base top 58 at an angle of approximately forty-five degrees and terminate at the bottom 65 of the housing of a slicing station 66. There is a conveyor/classifier guard 57 between side guards 62 and 63, below the bottom 65 of the housing for slicing station 66.

The slicing machine 50 of FIG. 1 further includes a computer display/touch screen 69 in a cabinet 67 that is pivotally mounted on and supported by a support (not shown) that projects outwardly from a member 74 that is a part of the housing of slicing head 66. Cabinet 67 and its computer display touch screen 69 are pivotally mounted so that screen 69 can face either side of slicing machine 50, allowing for operation of machine 50 from either side. Cabinet 67 also serves as a support for a cycle start switch 71, a cycle stop switch 72, and a loaf feed on-off switch 73. Switches 71–73 and screen 69 are all electrically connected to the computer in base 51.

The upper right-hand portion of slicing machine 50, as seen in FIG. 1, comprises a continuous automated loaf feed mechanism 1075. Automated loaf loading, into mechanism 1075, may be provided on either or both sides of machine 50; the same holds true for manual loaf loading. Indeed, different versions of slicing machine 50 may have automated loaf loading from the near side and manual loading on the far side of the machine, or can be reversed as regards the sides using manual and automated loaf loading. Other versions of slicing machine 50 may have automated loaf loading or manual loaf loading on both sides of the slicing machine. Automated loaf loading is not illustrated.

There are some additional switches seen in FIG. 1. An emergency stop switch 89 is mounted on slicing station 66 on the near side of machine 50, and there is a similar switch (not shown) on the far side of the machine. Switch 89 (and any counterpart on the far side of the slicing machine 50) is electrically connected to the computer and other controls of the machine (not shown) in enclosure 53.

As shown in FIG. 1, slicing machine 50 is not yet ready for operation; there is no food loaf in its loaf feed mechanism 1075. When in operation, slicing machine 50 produces a series of stacks 92 of food loaf slices that are fed outwardly of the machine by conveyor/classifier system 64. Machine 50, when slicing two food loaves, also produces a series of stacks 93 of food loaf slices that also move outwardly of the machine on conveyor system 64. Stacks 92 and 93 are each shown as a stack of slices from a food loaf of round cross-section. Usually, both of the slice stacks 92 and 93 would be either round or rectangular. Stacks 92 and 93, as shown, contain the same number of food loaf slices in each stack. That is the usual operating condition. Both groups of slices can be overlapping, "shingled" groups of slices instead of having the illustrated stacked configuration. Groups 92 and 93 are always the same in one respect; both must be stacks or shingle groups. Three or more loaves can be sliced simultaneously; slicing of two loaves is more common.

There is a stack/shingle conveyor drive on the near side of slicing machine 50, within the housing or guard 62. One part of the drive for slicing station 66 is enclosed within an enclosure 104 on the near side of machine 50. A manual slicing station rotation knob (not shown) may be mounted in enclosure 104 for mechanical connection to the drive for slicing station 66. At the far side of slicing machine 50 there is an enclosure 105 for a knife drive. Slicing station drive enclosure 104 and knife drive enclosure 105 extend upwardly from table top 58 at an acute angle, preferably approximately 45°, corresponding to the angular alignment of the lower part of loaf feed mechanism 1075. There may also be a manual knife rotation knob (not shown) on the far side of slicing machine 50.

Slicing machine 50 includes a fixed frame supporting the automated loaf feed mechanism 1075 for feeding food loaves into slicing head 66. In the construction shown in FIG. 1, this fixed frame includes a pair of vertical frame members 111. The fixed frame also includes three near side frame members 113A, 113B, and 113C. There are similar fixed frame members, like members 113A—C, on the far side of slicing machine 50. Frame members 111 and 113A—C are all located above the top 58 of machine base 51.

As thus far described, apart from the continuous loaf feed mechanism 1075, machine 50 corresponds essentially to the slicing machines described in four prior U.S. patent applications Ser. Nos. 08/320,749, 08/320,750, 08/320,752 and 08/320,759, all filed Oct. 11, 1994. Application Ser. No. 08/320,749 is now U.S. Pat. No. 5,566,600 issued Oct. 22, 1996, Ser. No. 08/320,750 is now abandoned, Ser. No. 08/320,752 was allowed Jan. 16, 1997, and Ser. No. 08/320, 759, allowed Sep. 11, 1996, is pending. The output from slicing machine 50, such as slice groups 92 and 93, may be transferred to a takeaway and correction conveyor of the kind described in U.S. patent application Ser. No. 08/387, 324, filed Feb. 13, 1995, now U.S. Pat. No. 5,499,719 issued Mar. 19, 1996.

The Continuous Food Loaf Feed, FIGS. 2 Through 6

A preferred construction for most of the continuous loaf feed mechanism 1075, which is the subject of the present invention, is illustrated in FIGS. 2 through 9A. The lower portion of loaf feed mechanism 1075, the part immediately adjacent to slicing station 66, is shown in detail in FIGS. 2–8. The support for the upper portions of the food loaves, at the right-hand end of machine 50 (FIG. 1), is illustrated in detail in FIGS. 9 and 9A.

Figure 2:
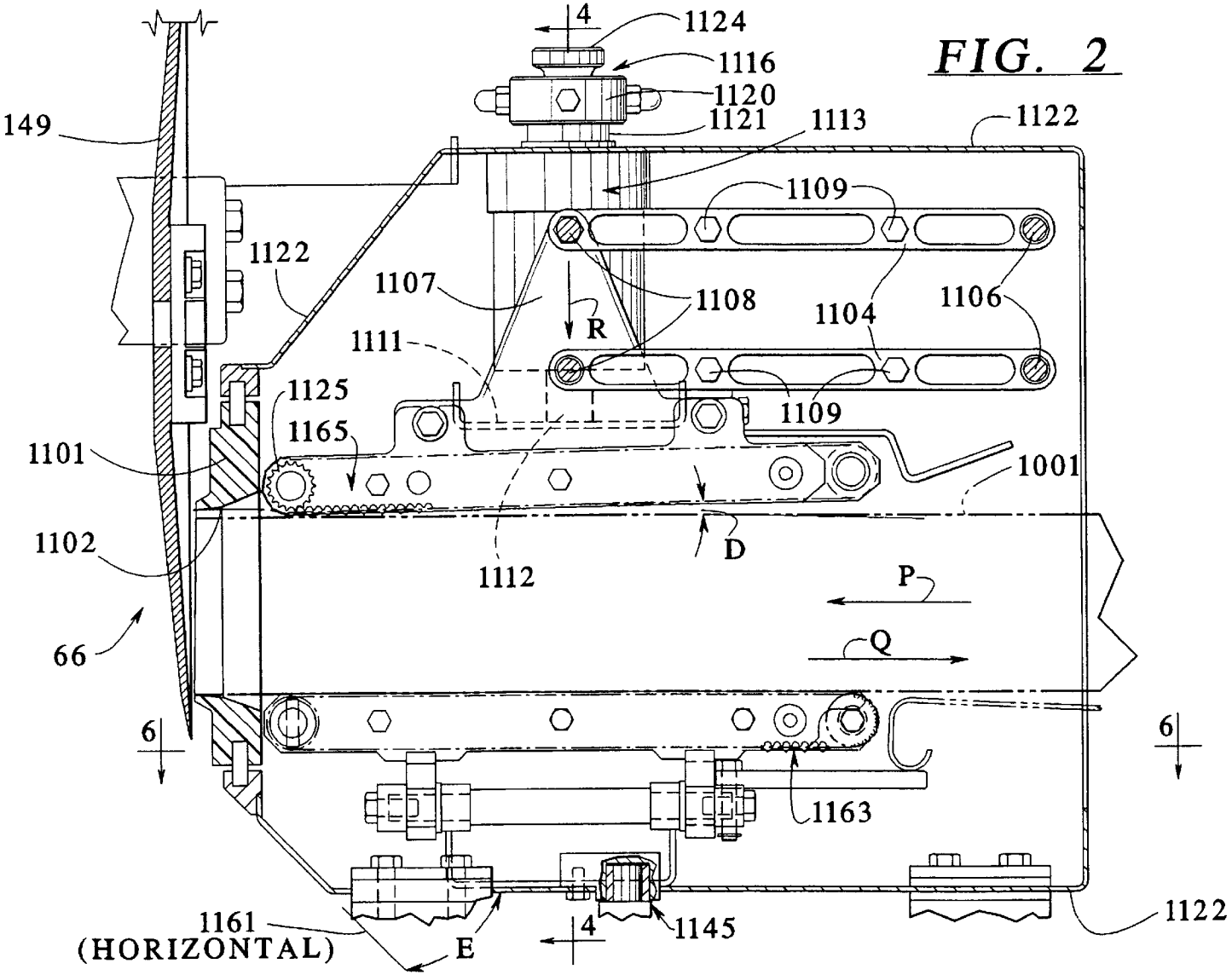
FIG. 2 is a sectional elevation view of the junction between the loaf feed mechanism and the slicing station of the slicing machine of FIG. 1.

FIG. 2 affords a sectional view of the portion of continuous food loaf feed mechanism 1075 immediately ahead of slicing station 66 and its continuously rotating knife blade 149. Blade 149 may be of circular configuration, driven in both a rotating motion and an orbiting motion, as in the slicing station described in greater detail in prior U.S. patent application Ser. No. 08/320,752, now allowed. Alternatively, blade 149 may be of an arcuate configuration, with rotating motion only, as exemplified by the alternate blade 949 shown in that same U.S. patent application. Blade 149 cuts slices from the front end of a food loaf 1001 that is advanced through an orifice 1102 in a plastic shear edge or orifice member 1101 of the kind shown in FIGS. 13–17 and described more completely hereinafter. FIG. 2 has been tilted through an angle E of approximately forty-five degrees so that it fits more readily on the drawing sheet; the horizontal is indicated by line 1161.

The movement of loaf 1001, during slicing, is in the direction of arrow P, FIG. 2, toward slicing station 66. In part, the movement of loaf 1001 in the direction of arrow P is afforded by gravity and by the weight of the food loaf itself; the lower end of mechanism 1075 is actually at an angle of forty-five degrees to the horizontal but has been re-oriented in FIG. 2, as noted above. The rate at which loaf 1001 moves into slicing station 66 is controlled by a pair of "short" conveyors 1163 and 1165, which have a common drive and operate at the same speed. The lower "short" conveyor 1163 and a companion short conveyor 1164 on the far side of the slicing machine are described in greater detail hereinafter in connection with FIGS. 10–12. Loaf feed mechanism 1075 includes two pairs of "short" conveyors, as further explained hereinafter, particularly in regard to FIGS. 4 and 5.

In this specification the term "short", as applied to the conveyors that feed loaves into the slicing station 66 of the machine, refers to the length of the conveyors in the loaf feed direction, arrow P. The conveyor length is not critical; a typical length for conveyors 1163 and 1165, FIG. 2, is about twelve inches (thirty cm). The upper surface of the lower "short" conveyor 1163 is parallel to the direction of loaf feed, arrow P; lower conveyor 1163 engages the bottom surface of loaf 1001 and is aligned with the bottom of aperture 1102 in orifice member 1101. The location of conveyor 1163 can be adjusted vertically, in a direction normal to arrow P, to accommodate food loaves of different sizes, as explained more fully hereinafter. The upper "short" conveyor 1165 is preferably inclined at a small angle D to the upper surface of loaf 1001 (FIG. 2) and hence may contact only a part of loaf 1001 immediately ahead of orifice 1102 in member 1101. Angle D should be less than five degrees; as shown in FIG. 2 it is about two degrees.

Figure 3:
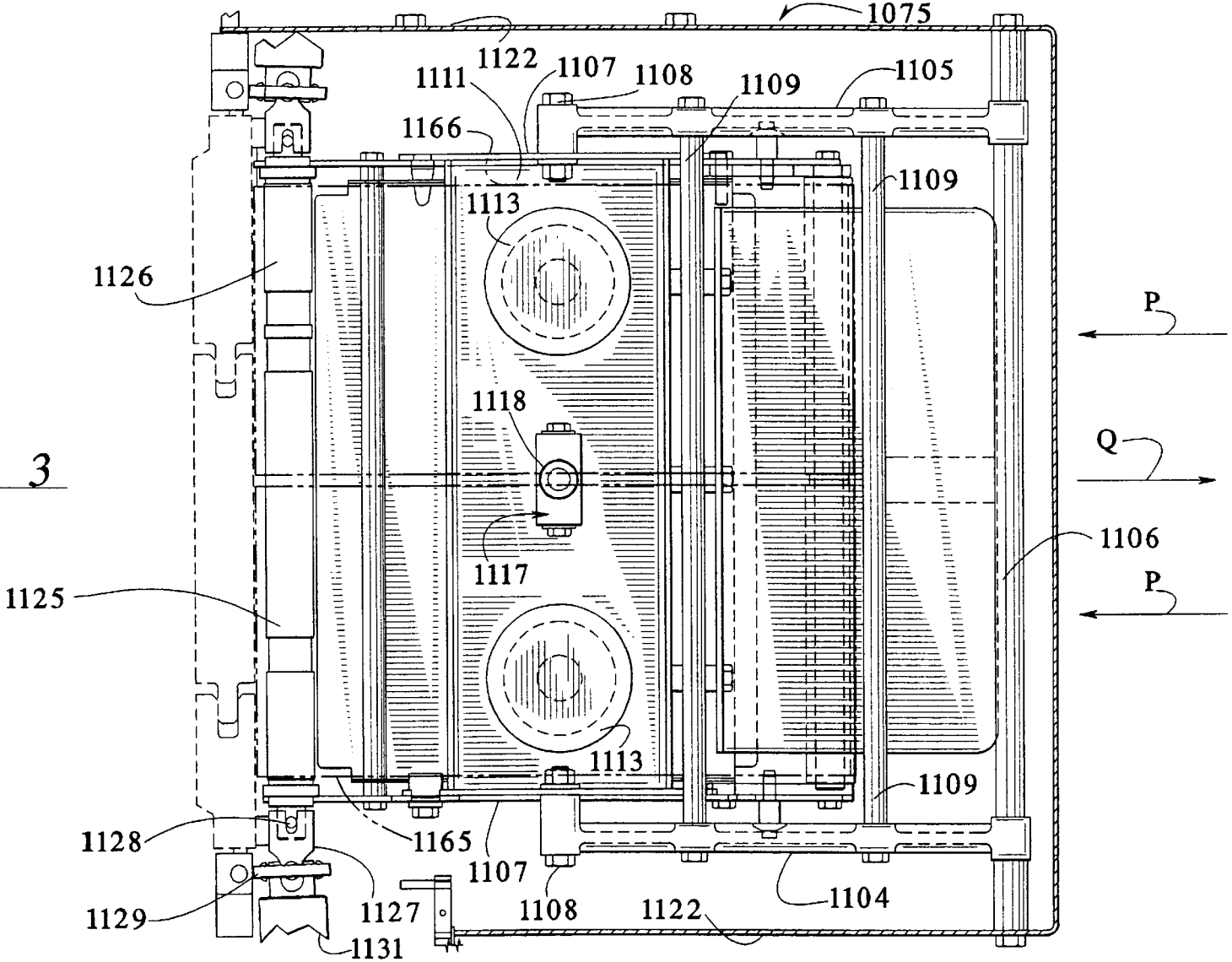
FIG. 3 is a plan view of part of the loaf feed mechanism shown in FIG. 2.
Figure 4:
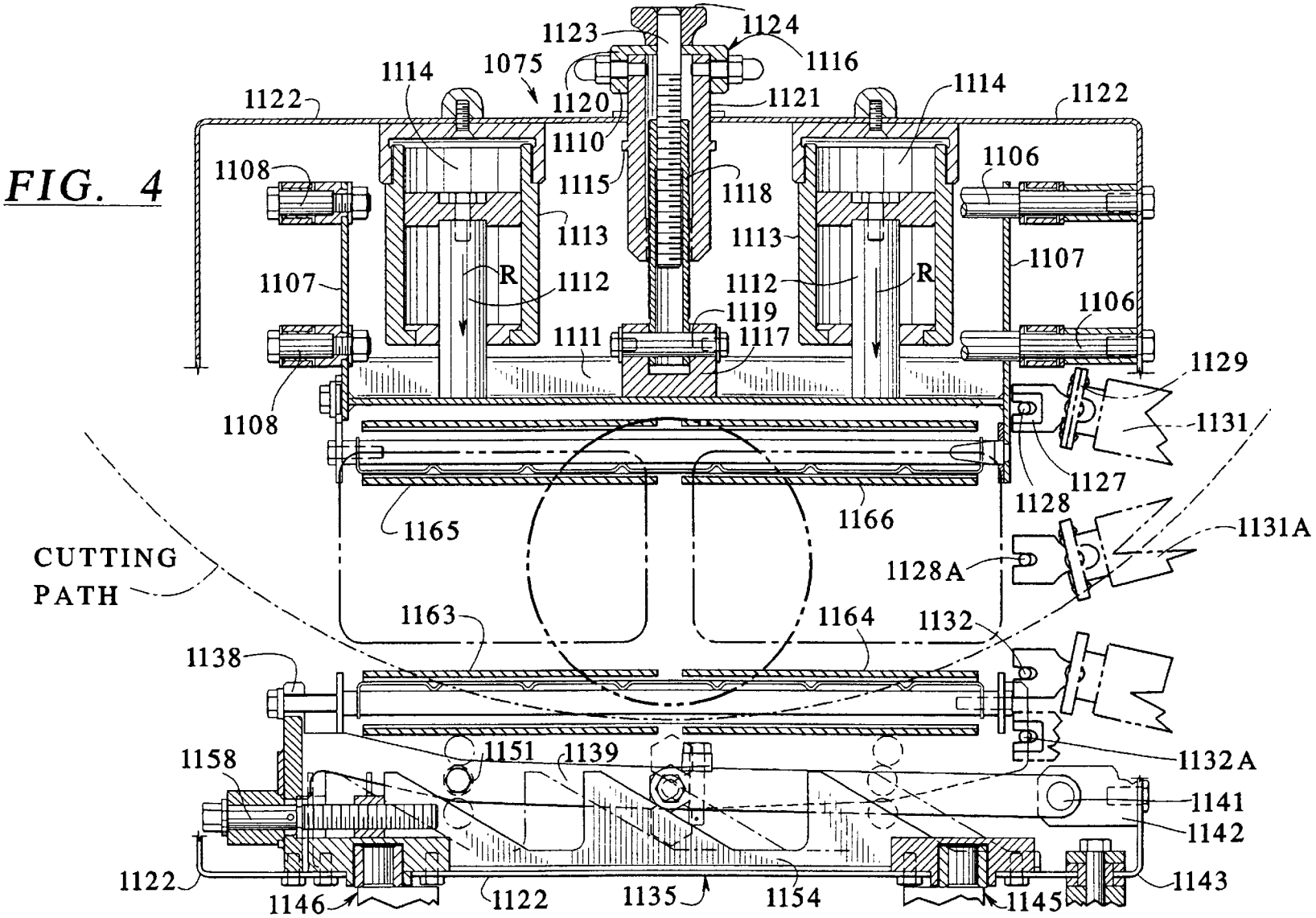
FIG. 4 is a sectional view taken approximately as indicated by line 4—4 in FIG. 2.

As shown in FIGS. 2, 3 and 4, the upper short conveyor 1165 and a like upper short conveyor 1166 on the far side of the slicing machine are supported by two dual-arm yokes 1104 and 1105. One end of each yoke arm is pivotally mounted on one of two transverse shafts 1106. The mounting for the two upper short conveyors comprises a pair of support members 1107 that are pivotally mounted on the ends of yokes 1104 and 1105 opposite shafts 1106 by the pins 1108. Yoke arms 1104 and 1105 are interconnected by shafts 1109 (FIGS. 2 and 3) that are parallel to shafts 1106. There is a channel 1111 that is mounted on and extends across the mechanism between support members 1107; see FIG. 4. The base of channel 1111 is engaged by the piston rods 1112 of two pressure cylinders 1113. The upper chambers 1114 of cylinders 1113 are suspended from a housing 1122 and are maintained under pressure, pneumatically. Thus, channel 1111 remains under pressure in the direction indicated by arrows R in FIGS. 2 and 4 to assure firm engagement of the upper conveyors 1165 and 1166 with the meat loaves they are aligned with.

The positions of the upper conveyors 1165 and 1166, FIGS. 2–4, are made adjustable toward and away from the food loaves so that feed mechanism 1075 can accommodate a variety of different sizes and shapes of food loaves. The basic adjustment is provided by an adjustment mechanism 1116, shown in section in FIG. 4 and also appearing in FIGS. 2 and 3. Mechanism 1116 includes a lower pressure block 1117 (FIG. 4) that engages the central portion of channel 1111 and that is pivotally connected to an internally threaded tubular member 1118 by a pin 1119. Tube 1118 extends upwardly into a cylinder 1121 that is supported by the housing 1122; housing 1122 encloses the lower part of loaf feed mechanism 1075, including all of the conveyors 1163–1166. A shaft 1123 affixed to a handle 1120 and a locking handle 1124 extends down through cylinder 1121 and is threaded into tube 1118. Handle 1120 rotates cylinder 1121 to adjust the vertical position of block 1117, as seen in FIG. 4, for a given size of food loaf; the heights of the food loaves sliced in machine 50, whether two, three, or more loaves are being sliced, should ordinarily be approximately the same. The upper conveyors 1165,1166 can float vertically between surfaces 1110 and 1115 to accommodate variations in food loaf dimensions; see FIG. 4.

Upper conveyors 1165 and 1166 share a common front shaft on which two drive pulleys 1125 and 1126 are supported; see FIG. 3. The drive pulley 1125 for the near side upper conveyor 1165 has a telescoping universal joint drive also shown in FIG. 4. That drive, FIG. 4, includes a connector 1127 at one end, connected by a pin 1128 to a universal joint 1129 that is the output member of a rotary conveyor drive member 1131. See FIGS. 3 and 4. A like drive, on the far side of slicing machine 50, is provided for the other short upper conveyor 1166; see FIG. 3. The drive pulleys 1125 and 1126 for the two short upper conveyors, FIG. 3, may operate at identical rotary speeds, but their rotational speeds may also vary to a limited extent to compensate for differences in food loaf sizes or to produce somewhat heavier slice stacks (or shingle groups) on one side of the machine than on the other. The telescoping universal joint drive connections allow effective drive connections to the upper conveyors 1165 and 1166 over an appreciable range of positions for those conveyors. Conveyors 1165 and 1166 preferably use conveyor belts constructed like timing belts and having transverse teeth engaging toothed drive pulleys so that positive control of conveyor belt speeds is consistently realized.

The two lower "short" conveyors 1163 and 1164 of the continuous loaf feed mechanism 1075 also share a support shaft on which two separate and separately driven drive pulleys are mounted. Conveyors 1163 and 1164 also utilize telescoping universal joint drive connections that are essentially the same as described for the related upper conveyors 1165 and 1166. FIG. 4 illustrates the range of elevations possible for the drive connections for both the upper and lower "short" conveyors. Drive pin 1128 for upper conveyor 1166 is shown at its highest elevation in FIG. 4 but can be moved as low as the phantom position 1128A by means of mechanism 1116; with the pin at position 1128A, the drive member for the pin is at position 1131A. Similarly, the drive connection pin 1132 for lower conveyor 1164 may be shifted down to phantom position 1132A by use of the vertical positioning apparatus 1135 for the lower conveyors; apparatus 1135 is described hereinafter in connection with FIGS. 5 and 5A–5F. The same arrangements are used, on the other side of the slicing machine (not shown) for conveyors 1163 and 1165. For both sides of the slicing machine, the telescoping universal-joint drives for the conveyors facilitate vertical adjustments to accommodate a broad range of different food loaf sizes.

Figure 5:
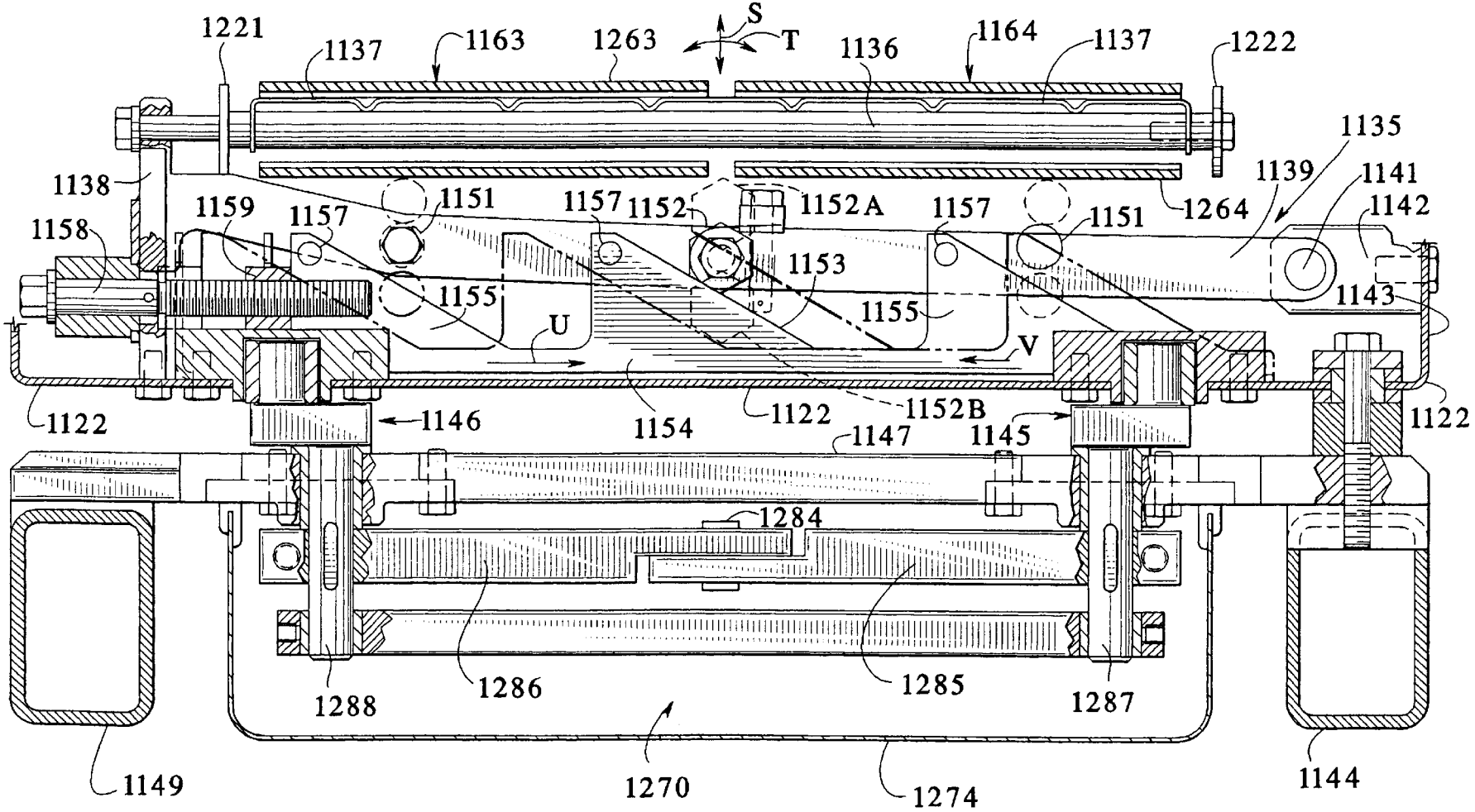
FIG. 5 is a sectional view like the lower portion of FIG. 4, but on an enlarged scale.
Figure 5A:
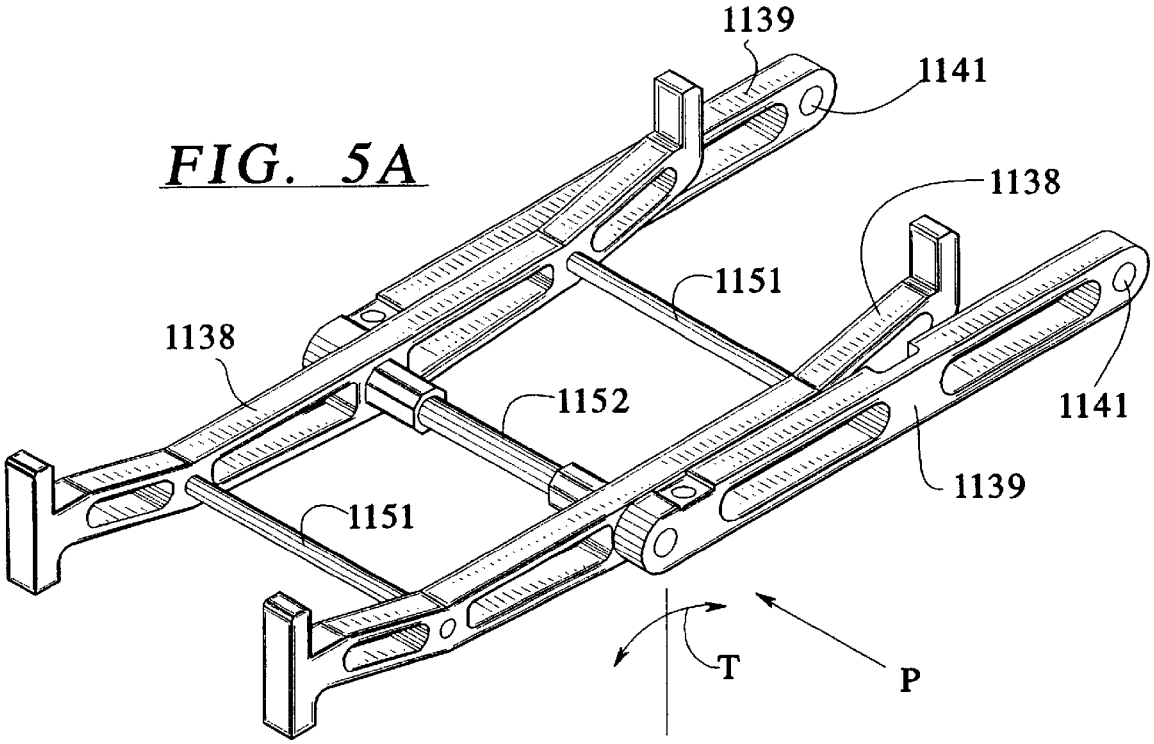
FIG. 5A is a simplified perspective view used to explain a part of the mechanism of FIG. 5 used to support a pair of short loaf feed conveyors.
Figure 5B:
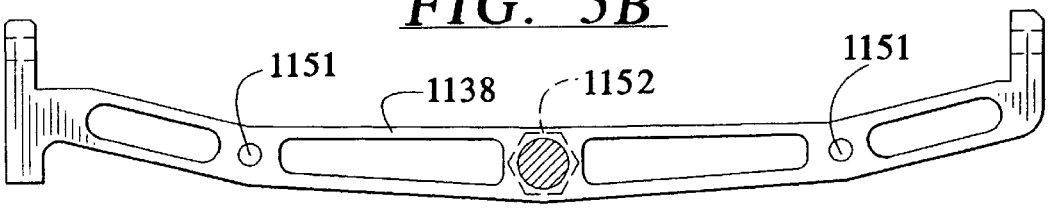
FIGS. 5B and 5C are detail views of members shown in FIG. 5.
Figure 5C:
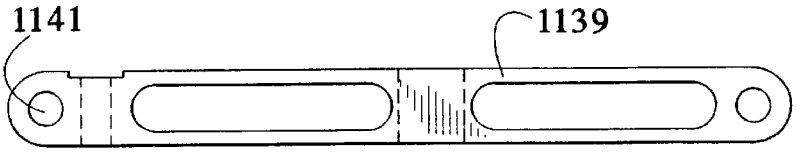
Figure 5D:
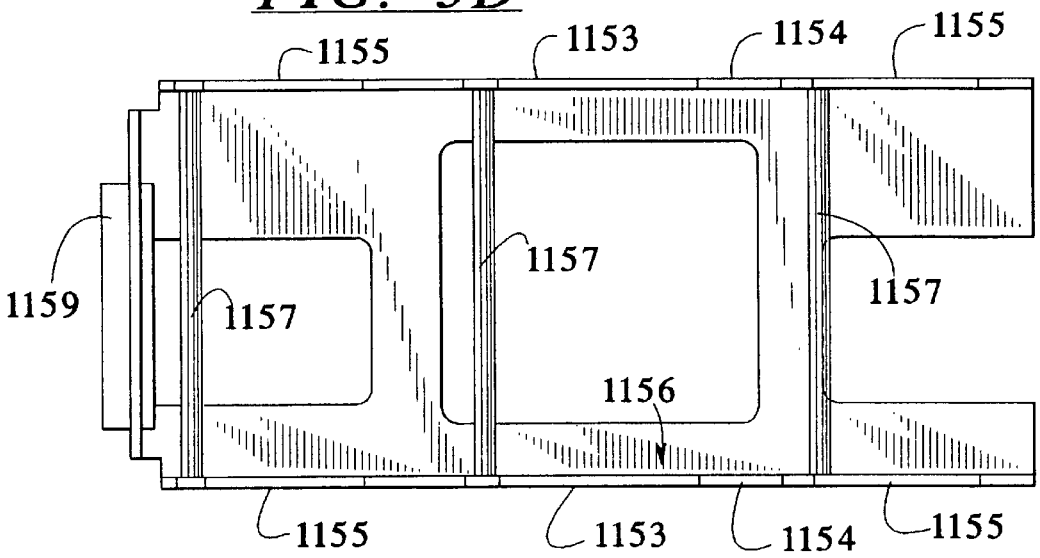
FIGS. 5D–5F are detail views of a sub-assembly from FIG. 5.
Figure 5E:
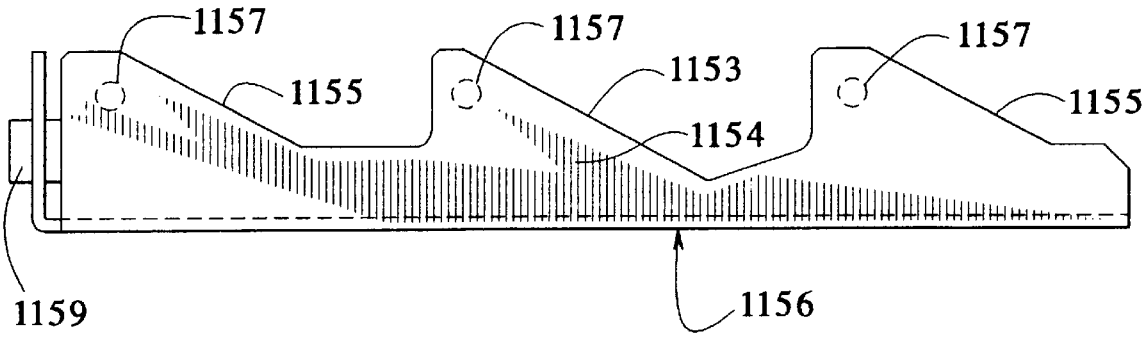
Figure 5F:
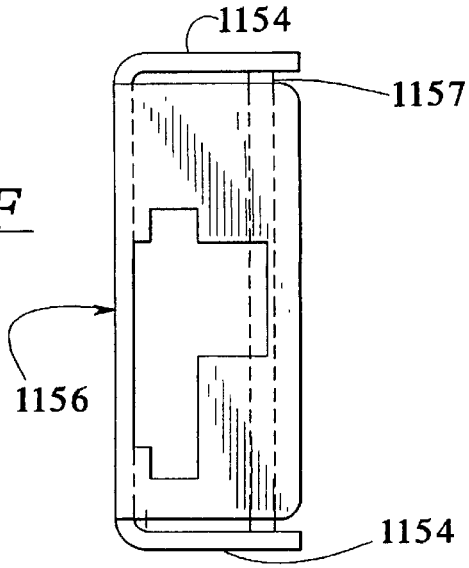

FIG. 5 illustrates the assembled apparatus 1135 used for support and for vertical positioning of the lower "short" conveyors 1163 and 1164, which can move a limited distance in the direction of the arrows S. As shown in FIG. 5, the two lower short conveyors 1163 and 1164 are located side-by-side. Each lower conveyor is supported on a pair of shafts 1136 (only one shaft 1136 is shown in FIG. 5). A stiff metal support band 1137, mounted on each of the shafts 1136, maintain the conveyor belts 1163 and 1164 elevated a short distance above the shafts; see also FIGS. 10–12. Supports 1137 and shafts 1136 are both stationary; they do not rotate. There are two support members 1138, each pivoted to one end of each of two elongated linear arms 1139 that extend across the slicing machine, as shown in FIGS. 5 and 5A. The preferred shape for each support 1138, as shown in FIG. 5B, is somewhat arcuate, rather like the rocker of a rocking chair. The shape of arms 1139 is best shown in FIG. 5C. The other end of each arm 1139 is pivotally mounted on a bracket 1142 by a pin 1141 (FIG. 5). Brackets 1142 are each secured to a support 1143 that is a part of housing 1122. Support 1143 extends upwardly from a frame member 1144 at one side of the slicing machine base. Housing 1122 extends across the full width of the two lower "short" conveyors. The housing is supported by two eccentric supports 1145 and 1146, which are connected on an elongated base member 1147 that extends from frame member 1144 to another frame member 1149 on the opposite side of the slicing machine from frame member 1144 (FIG. 5).

The relationship of component members in the support for the two lower "short" conveyors in slicing machine 50 is more clearly shown in the perspective of FIG. 5A. The "short" conveyors may have additional idler pulleys and medial shafts, as described in connection with FIGS. 10–12. There are also two shafts 1151 and a hexagonal central shaft 1152, mounted between arms 1138, that are part of the support for the lower conveyors. The configuration of the cantilever support arms 1139, on which rocker arms 1138 are mounted (FIGS. 5 and 5A) is best shown in FIG. 5B.

As shown in FIG. 5, the central hexagonal shaft 1152 of the rocker-arm support for the lower short conveyors 1163 and 1164 engages the central cam ramp 1153 of a vertical adjustment member 1154 which has two additional end ramps 1155. In the preferred construction there are actually two vertical adjustment members 1154; members 1154 are the opposite sides of a lift deck 1156. The two vertical adjustment members 1154 are interconnected by three spacer shafts 1157, to maintain equal spacing between them. As previously noted, the central hexagonal shaft 1152 engages the center ramps 1153 of the vertical adjustment members 1154 of lift deck 1156, and thus establishes the basic elevation of the two short conveyors 1163 and 1164; see FIG. 5. The hexagonal shaft 1152 is shown in an intermediate position in FIG. 5; it can be moved upwardly to the phantom position 1152A by movement of lift deck 1156 to the right (arrow U, FIG. 5) or can be moved downwardly to the phantom position 1152B by movement of lift deck 1156 and its vertical adjustment members 1154 to the left (arrow V, FIG. 5). The movements of shaft 1152 result in corresponding movements of conveyors 1163 and 1164 in the directions indicated by arrows S, and serve to accommodate feed mechanism 1075 to different food loaf sizes; of course, some of the loaf size variation is accommodated by movement of upper conveyors 1165 and 1166 as described above in connection with FIG. 4. The construction of lift deck 1156 is best shown in the detail views, FIGS. 5D–5F.

If food loaves were truly consistent in cross-sectional size throughout their lengths, no further accommodation movements by mechanism 1135, FIG. 5, would be required. Unfortunately, food loaf size consistency is not always assured. Two food loaves, though nominally of the same size, may vary appreciably in cross-sectional dimensions, occasionally by as much as one-fourth inch (0.65 cm). Indeed, one food loaf may increase or decrease by a comparable amount, in cross-sectional size, from one end of the loaf to the other.

That is the reason for the end ramps 1155 of the two vertical adjustment members 1154, FIGS. 5 and 5D–5F. When the loaf engaging lower conveyor 1163 is marginally larger than the loaf on conveyor 1164 those conveyors tilt in the counter-clockwise direction of arrows T (FIG. 5). However, if the loaf on conveyor 1164 is slightly larger than the loaf on conveyor 1163, the arrow T tilt is clockwise. Counter-clockwise tilt of the lower conveyors is limited by engagement of one shaft 1151 (left-hand side in FIG. 5) with its associated ramp 1155; clockwise tilt is limited by the other shaft 1151 engaging its aligned ramp 1155. See FIG. 5. The vertical position of the two rocker arms 1139 that support lower conveyors 1163 and 1164 is adjusted to accommodate a given loaf size by means of a threaded shaft 1158 (FIG. 5) engaged in a block 1159 (FIGS. 5, 5D and 5E) in the vertical end of lift deck 1156. The tilt adjustment is effected by the food loaves themselves.

Figure 6:
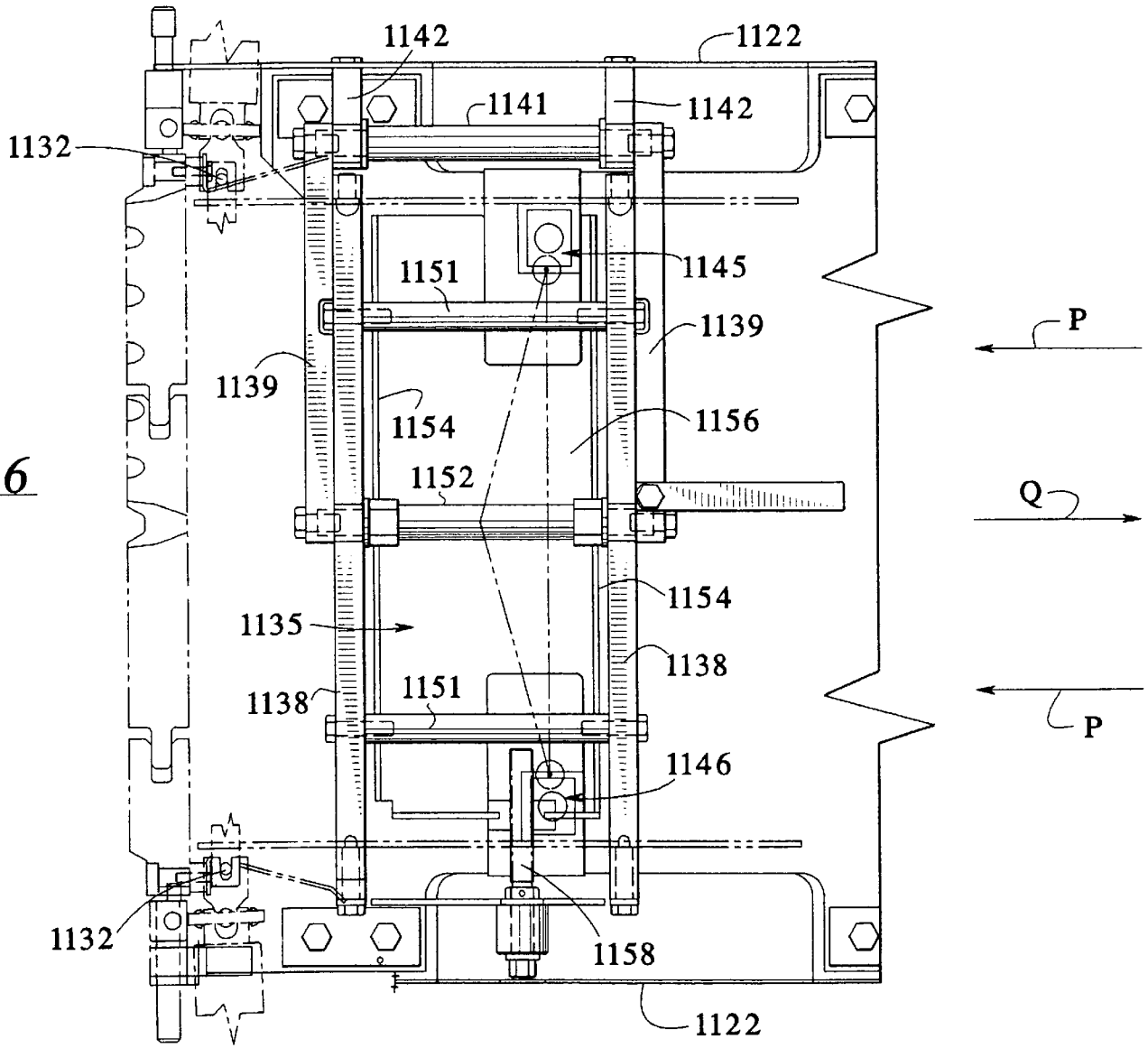
FIG. 6 is a sectional plan view, taken approximately as indicated by line 6—6 in FIG. 2, simplified to show the conveyor support mechanism of FIG. 5 and a portion of the retraction mechanism of FIGS. 2, 5, 7 and 8.

Many of the components of the support mechanism 1135 for the lower "short" conveyors that is shown in FIGS. 5 and 5A–5F also appear in the simplified plan view of FIG. 6. The functions of those components have already been described. In all instances it must be remembered that FIGS. 2, 3, 4, 5 and 6 have been rotated through an angle E, as indicated in FIG. 2; they are not true horizontal plan and vertical elevation views. That is, line 1161 in FIG. 2 corresponds to the horizontal top 58 of base 51 (FIG. 1). The tilt has been effected, in the drawings, to fit the individual Figures onto their respective drawing sheets with minimal size reduction.

The Retraction Mechanism, FIGS. 7, 7A, 8 and 8A

Figure 7:
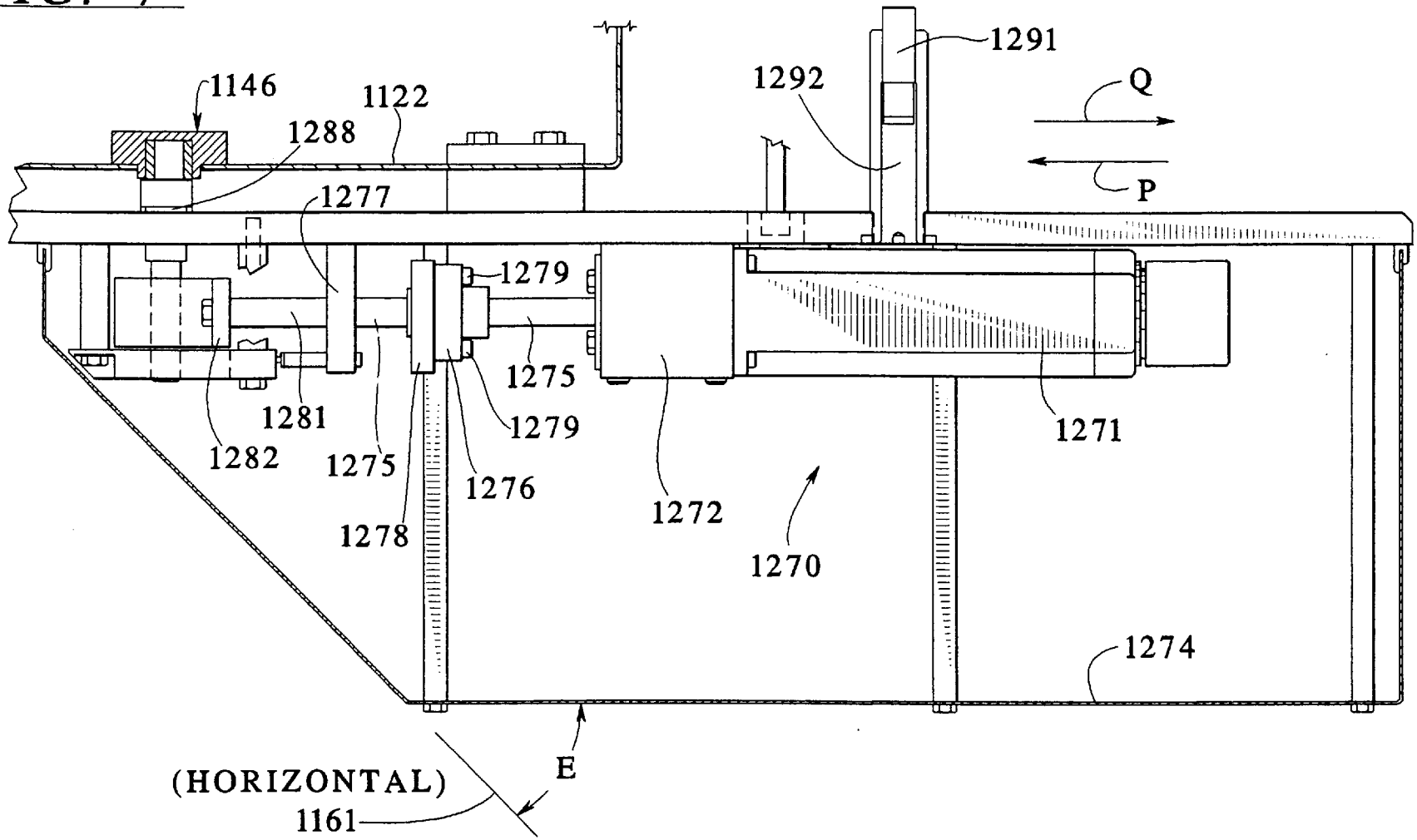
FIG. 7 is a sectional elevation view, on an enlarged scale, of a preferred retraction mechanism that is similar to the mechanism in the lower part of FIG. 2 but with some modification.
Figure 7A:
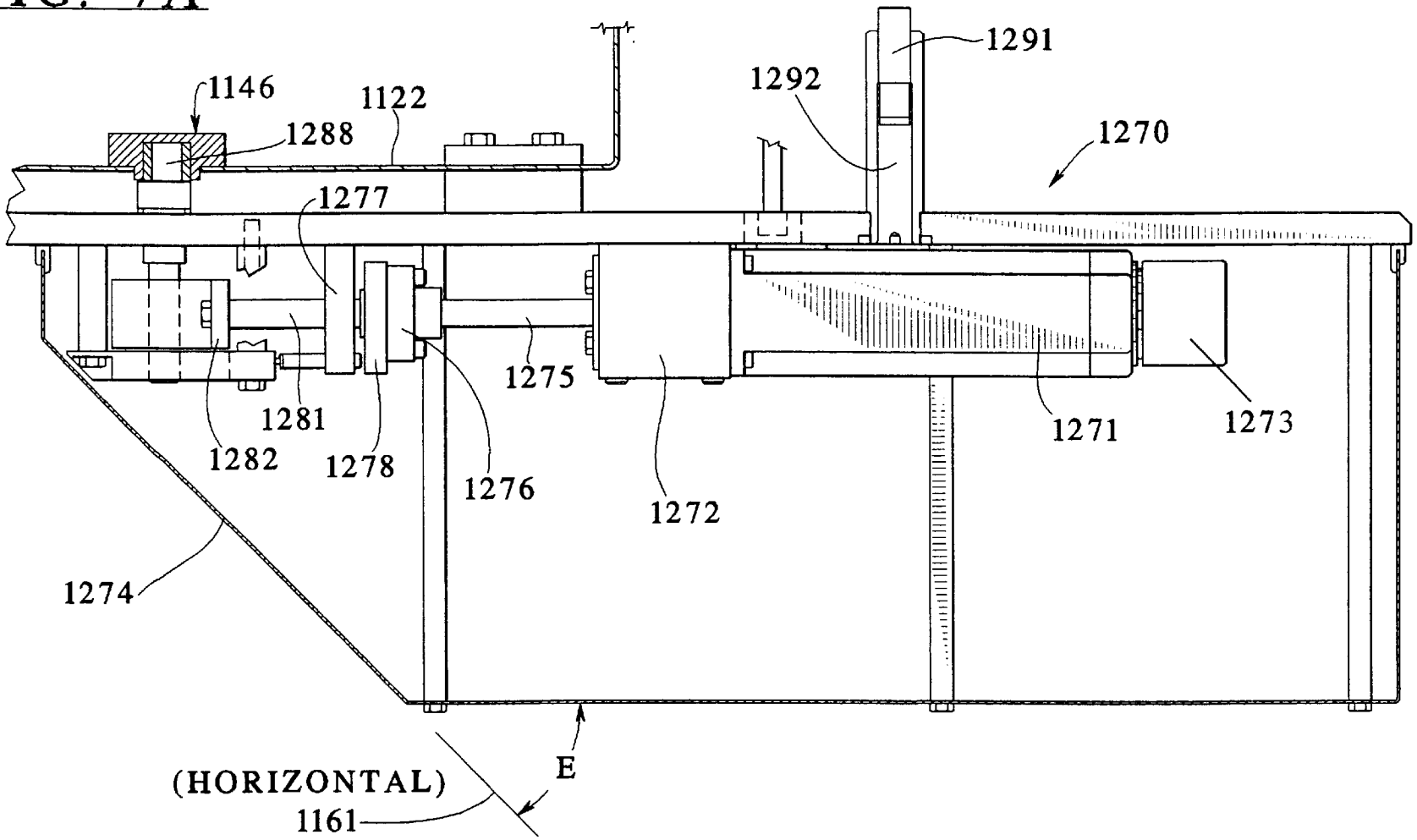
FIG. 7A is a detail section elevation view showing part of the retraction mechanism in its retracted position.
Figure 8:
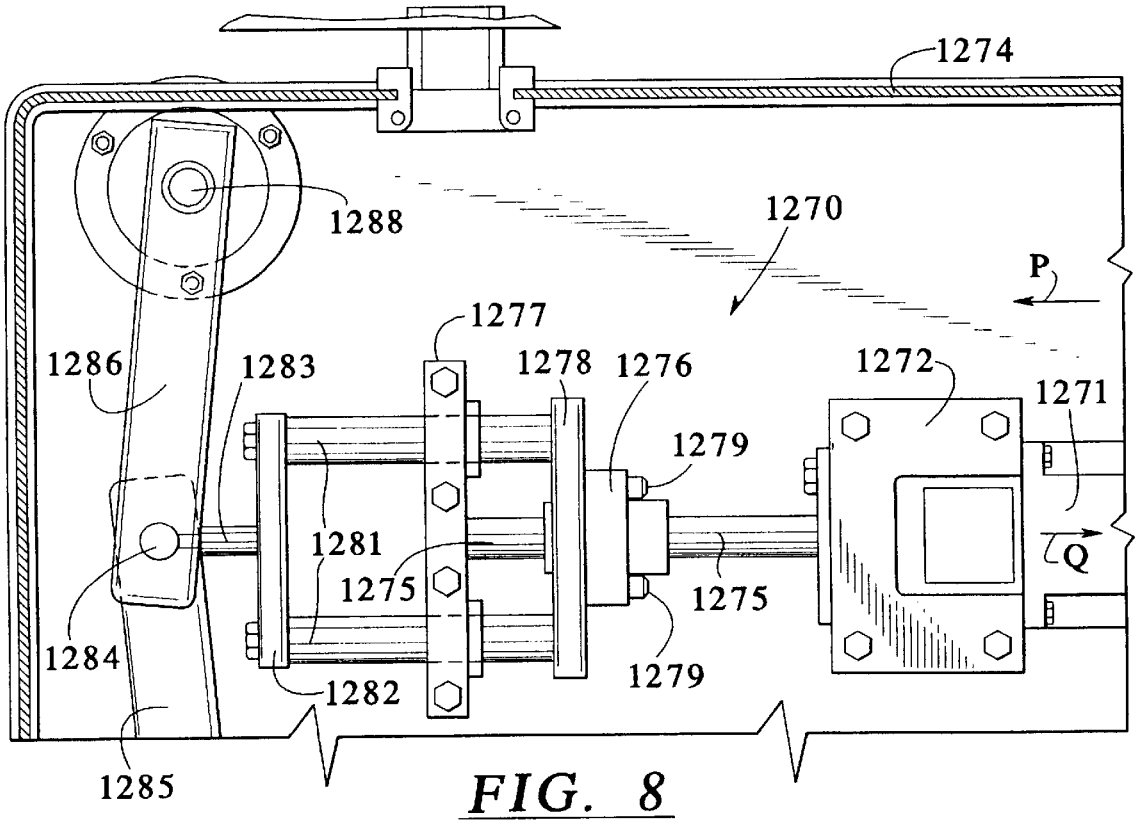
FIG. 8 is a bottom view of a part of the retraction mechanism of FIG. 7.
Figure 8A:
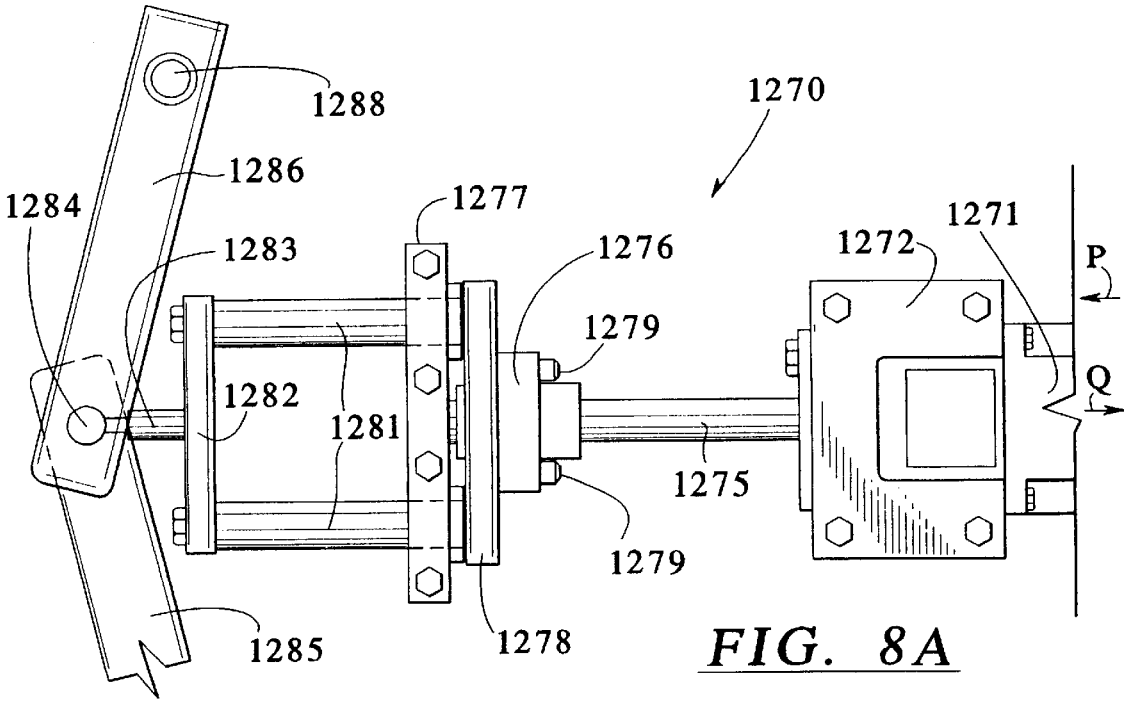
FIG. 8A is a detail view showing part of the retraction mechanism of FIG. 8 in the same retracted position as illustrated in FIG. 7A.

FIGS. 7 and 8 illustrate a preferred construction for a retraction mechanism 1270 that moves the entire lower, driven apparatus for the loaf feed, including the orifice/shear edge assembly, away from the slicing station of the machine, and hence away from its slicing blade 149 (FIG. 2), whenever a stack is complete or there is some other reason to interrupt slicing. In FIGS. 7 and 8 mechanism 1270, which is enclosed in a fixed housing 1274, is shown in its slicing position. FIGS. 7A and 8A show the retracted position for mechanism 1270. The total distance for the retraction motion of mechanism 1270, moving the previously described housing 1122 and both of the "short" conveyor mechanisms, is quite small, usually less than one-eighth inch (0.3 cm) and preferably no more than one-sixteenth inch (0.15 cm.).

The impetus for operation of retraction mechanism 1270 is provided by a servomotor 1271 mounted on a fixed mount 1272 as shown in FIGS. 7 and 8. Servomotor 1271 drives a shaft 1275; shaft 1275 is a ball-screw drive shaft having a helically threaded surface engaged by a ball nut 1276 having a helical internal thread. When servomotor 1271 is energized it rotates shaft 1275; rotation of the shaft moves nut 1276 in the retraction direction (arrow Q) or in the restoration direction (arrow P), depending on the direction of rotation of shaft 1275. The retraction and restoration directions of arrows Q and P are directly opposed to each other; restoration direction P is the same as the direction of movement of food loaves during slicing, as previously described.

One end of shaft 1275, the right-hand end of the shaft as seen in FIGS. 7 and 8, is journalled in a suitable bearing in a fixed support member 1272. In operation the servomotor shaft 1275 rotates, but it does not move axially; rotational movement of the servomotor shaft is translated into linear motion by ball nut 1276. Nut 1276 is affixed to a yoke 1278 by suitable means such as the bolts 1279. A pair of shafts 1281 project outwardly from yoke 1278, through support member 1277, and are secured to a further yoke 1282. A telescoping shaft 1283 projecting from yoke 1282 engages a pin 1284 that interconnects two eccentric actuator arms 1285 and 1286. Arms 1285 and 1286, which also appear in FIG. 5, are pivotally interconnected at one end by pin 1284. The other ends of arms 1285 and 1286 are connected to the shafts 1287 and 1288 of eccentrics 1145 and 1146, respectively, as shown in FIG. 5.

Before food loaf slicing begins the retraction mechanism 1270 is in the retracted position shown in FIGS. 7A and 8A, with housing 1122 for the "short" conveyors and other positive food loaf drive components pulled away a short distance from the slicing station of machine 50. When slicing begins, servomotor 1271 is energized and rotates the ball screw shaft 1275 of mechanism 1270. As a consequence, nut 1276 moves forward (to the right as seen in the drawings) from the position of FIGS. 7A and 8A to the slicing position shown in FIGS. 7 and 8. The two eccentric actuator arms 1285 and 1286 follow shaft 1283. Accordingly, eccentrics 1145 and 1146 rotate to move housing 1122 and the mechanism it encloses, along with the food loaves, into slicing position.

Thereafter, each time slicing is interrupted, as on completion of a slice group or groups, servomotor 1271 is energized and retraction mechanism 1270 retracts the entire loaf feed mechanism and the loaves in the direction of arrow Q. The retraction distance is quite small, as previously noted, but must be sufficient to preclude further slicing of the food loaves. When the completed sliced groups (e.g., slice stacks 92 and 93, FIGS. 1) are removed from slicing station 66 by takeaway conveyor system 64, servomotor 1271 (FIGS. 7A,8A) is again energized and drives mechanism 1270 back to the slicing position shown in FIGS. 7 and 8. The retraction and restoration movements can be quite small, frequently less than one-fourth inch (0.6 mm), but are essential to effective overall operation. The retraction distance is dependent on the duration of the energization of servomotor 1271, and can be varied by the computer that controls slicing machine 50, based on the thickness of the slices being cut. Servomotor 1271 should include an encoder to assure accurate restoration at the beginning of each slicing operation.

When the end of a food loaf approaches the "short" conveyors in housing 1122, and thus approaches slicing station 66 (FIGS. 1 and 2), it is usually desirable to introduce a new food loaf into the slicing machine so that slicing can be continued with minimal interruption. This requires some means to determine when the end of a loaf is near housing 1122. This sensing function may be effected by a proximity switch 1291 mounted on a fixed support 1292 immediately ahead of housing 1122, as shown in FIGS. 7 and 7A. A similar proximity switch or other detector means would be located on the opposite side of the slicing machine for use in slicing two food loaves simultaneously. The food loaves may not have the same length. It is desirable to pass the transition between the old loaf and the new loaf (seam) through the orifice into the slicing station at the same time. If this is not done the partial slices and wedge shaped pieces that inevitably occur during a seam transition will disrupt the adjacent stack or draft. The computer controlling the slicing machine determines which loaf seam will occur first, through signals from the sensors 1291, and will stop feeding the shortest loaf until the seams are aligned, thereby assuring improved yields.

Figure 9:
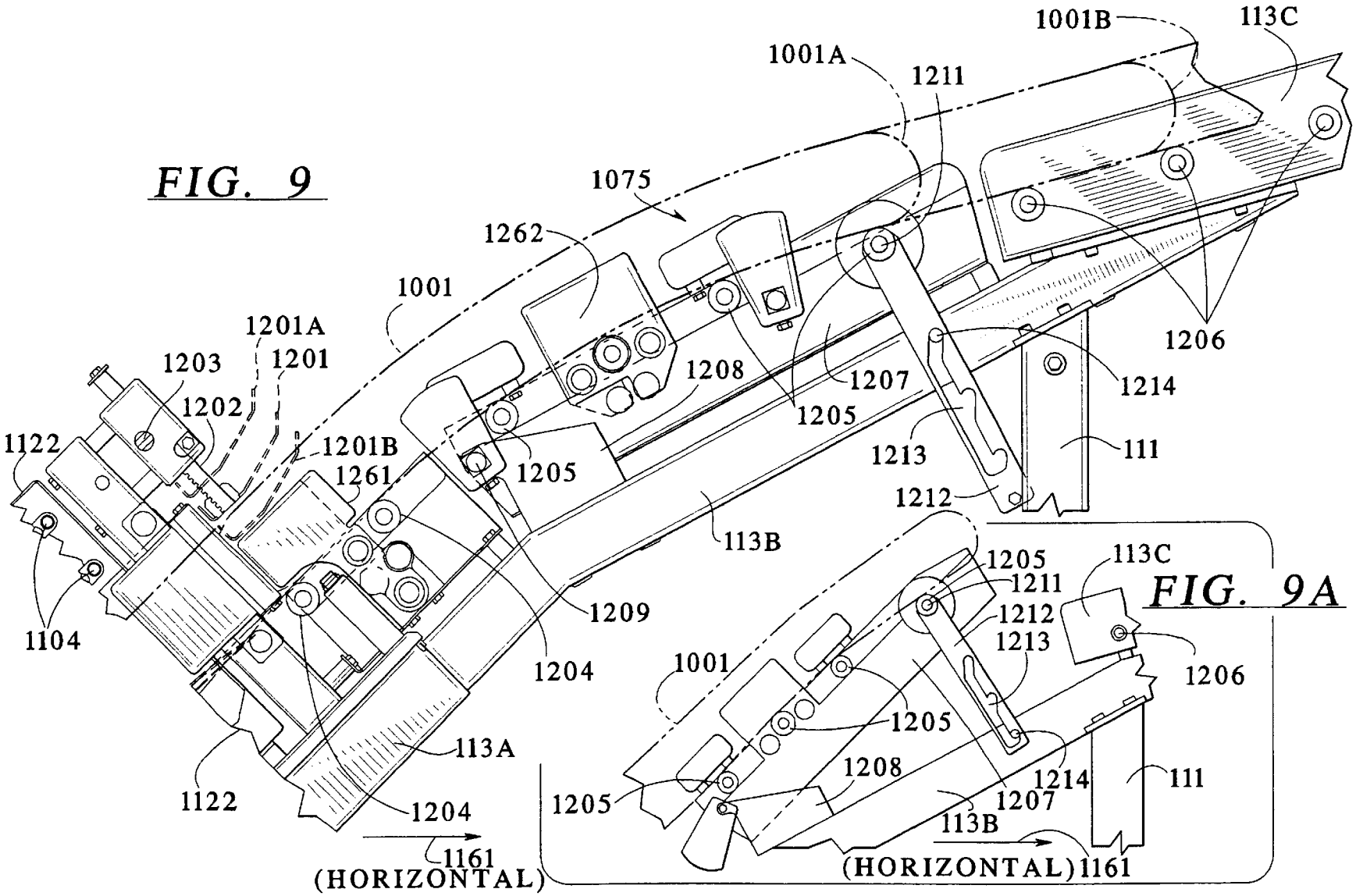
FIG. 9 is a side elevation view of the upper, gravity feed portion of the loaf feed mechanism of the slicing machine of FIG. 1.

The Upper (Gravity) Loaf Feed, FIGS. 9 and 9A

FIG. 9 affords an elevation view of the upper part of loaf feed mechanism 1075, the part of the loaf feed mechanism that supports the parts of food loaves 1001 extending angularly upwardly out of housing 1122. This is the gravity feed portion of the loaf feed mechanism 1075. The upper part of mechanism 1075 includes a resilient guide 1201 mounted on the lower end of a gear rack 1202 projecting from and actuated by a pinion gear shaft 1203. Guide 1201 can be moved to any desired position within the range indicated by phantom outlines 1201A and 1201B to accommodate food loaves of different sizes.

Above and immediately to the right of housing 1122 and guide 1201, as seen in FIG. 9, each food loaf 1001 is supported on a lower series of rollers 1204. Rollers 1204 extend across mechanism 1075 between frame members 113A. A medium length food loaf, ending at or extending past dash line 1001A, may extend upwardly onto a further series of rollers 1205. If loaf 1001 is even longer, extending to phantom line 1001B or beyond, the loaf engages and is supported by an additional series of rollers 1206. Rollers 1204 extend across mechanism 1075 above frame member 113A and remain in the position shown in FIG. 9 at all times. Similarly, rollers 1206 extend between fixed frame members 113C, and do not change position. Rollers 1205, however, can be shifted to the position shown in FIG. 9A when the slicing machine is processing relatively short food loaves, such as loaves having an initial length of about three feet (95 cm). This movement of rollers 1205 to the position shown in FIG. 9A is accomplished by pivotal movement of the two spaced supports 1207 between which rollers 1205 extend (only one support 1207 appears in each of FIGS. 9 and 9A). One end of each of the two support members 1207 is pivotally mounted on frame member 113B by two brackets 1208 (one shown) and a transverse shaft 1209.

The other ends of the roller support members 1207, opposite shaft 1209, are joined by a transverse shaft 1211 that also serves as the shaft for the uppermost roller 1205. The opposite ends of shaft 1211 project beyond the support members 1207; on the near side of the slicing machine, as shown in FIGS. 9 and 9A, shaft 1211 is journalled in a suitable bearing mounted on an adjustable support member 1212 that has a longitudinal three-position slot 1213 therein. Each of the slots 1213 engages a pin 1214 projecting from one frame member 113B to determine the elevation position of the right-hand end of one of the adjustable support members 1212 and thus establishes the elevation position of the two roller supports 1207. FIG. 9 shows one adjustable support 1212 at its lowest position; FIG. 9A illustrates the highest elevation for the same adjustable support 1212. The adjustable supports 1212 on both sides of machine 50 must be at the same elevation whenever the machine is in operation. One intermediate position for support 1212 is illustrated, determined by the configuration of slot 1213; additional intermediate positions could be realized but are not likely to be necessary. Sensors 1291 also indicate to the computer controlling machine 50 when to sweep new loaves into the slicing position. Two air actuated sweep paddles 1261 and 1262 push the loaves from the "ready position" into the slicing position immediately behind the loaves currently being sliced, so there is no gap between loaves.

Figures 10, 11, 12:
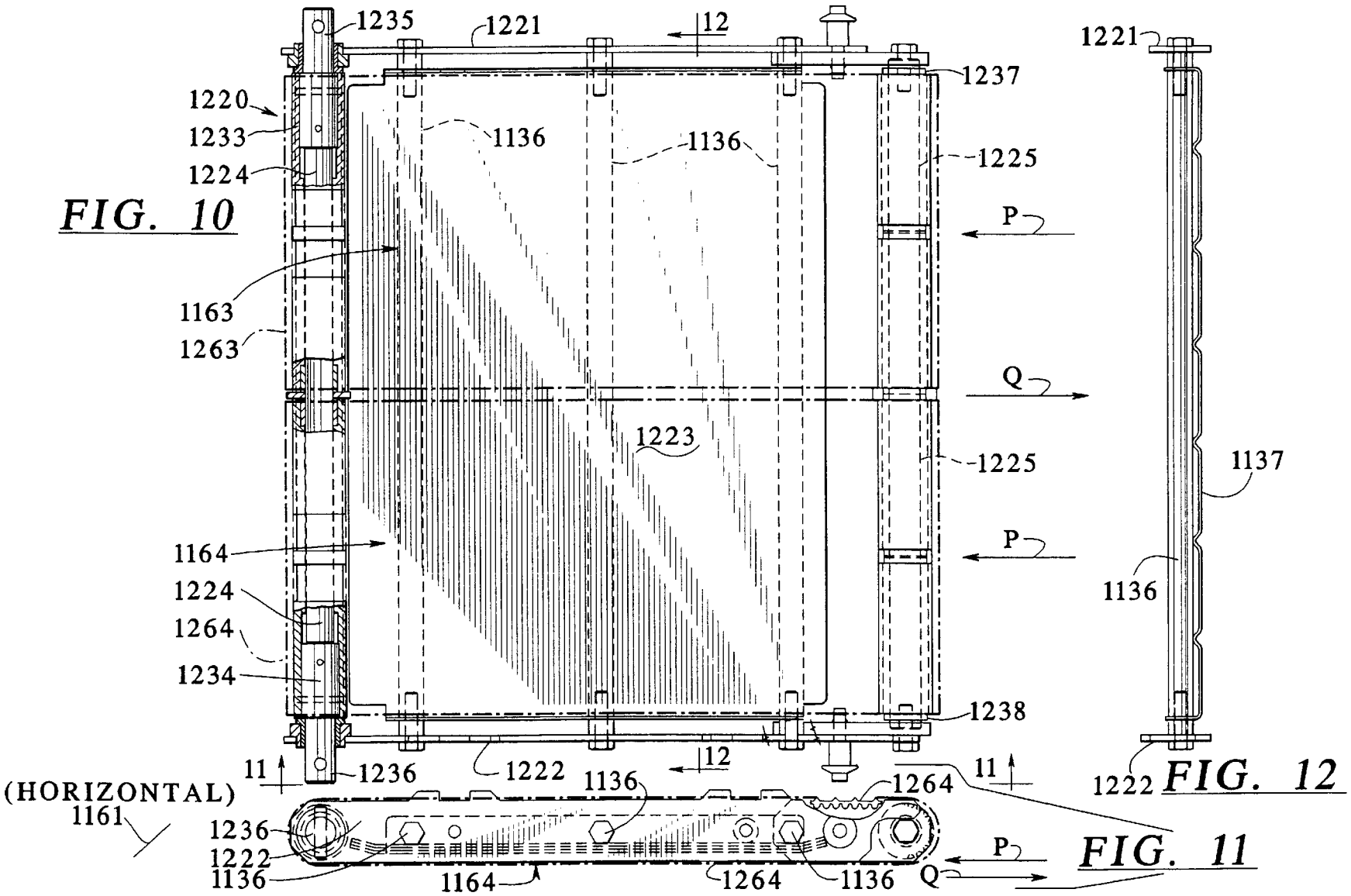
FIG. 10 is a bottom view of the lower "short" food loaf conveyors in the loaf feed mechanism, with the conveyor belts omitted.
FIGS. 11 and 12 are detail views taken approximately as indicated by lines 11—11 and 12—12 in FIG. 10.

The Lower Conveyors, FIGS. 10–12

FIGS. 10–12 illustrate a preferred construction for the lower conveyor unit 1220 of the slicing machine. FIG. 10 affords a bottom view of the lower "short" conveyor unit 1220, which includes both of the two lower loaf feed conveyors 1163 and 1164. FIGS. 11 and 12 are side and section views taken approximately along lines 11—11 and 12—12, respectively, in FIG. 10. The lower feed conveyors 1163 and 1164 are constructed as a unit, but they function independently in many respects.

The lower "short" conveyor unit 1220, FIG. 10, includes two spaced side plates 1221 and 1222; plate 1221 is on the near side of slicing machine 50 and plate 1222 is on the far side of the slicing machine. The shape of the far side plate 1222 is best seen in FIG. 11; the near side plate 1221 is the same. Plates 1221 and 1222 are held in fixed spaced relation to each other, in part, by a series of fixed shafts 1136. Each shaft 1136 carries a sheet metal belt support member 1137; see FIG. 12. This is the construction previously described, particularly in connection with FIG. 5. The belt for the lower "short" conveyor 1163 is indicated by phantom outline 1263 in FIG. 10; similarly, phantom outline 1264 shows the position an extent of the belt for the other conveyor 1164. Belt 1264 also appears in FIG. 11. The central portions of conveyor belts 1263 and 1264 are supported by members 1137, as shown in FIG. 5.

A double metal pan 1223 extends across the bottom of conveyor unit 1220 as shown in FIGS. 10 and 11. There are two stationary shafts 1224 and 1225 that extend between side plates 1221 and 1222 at the opposite ends of conveyor unit 1220 (FIG. 10). The drive pulley 1233 for belt 1263 is rotatably mounted on shaft 1224 and is connected to the drive shaft 1235 for conveyor 1163. Similarly, a drive pulley 1234 for belt 1264 is rotatably mounted on and supported by shaft 1224. Drive pulley 1234 is connected to the drive shaft 1236 for conveyor 1164. Two idler pulleys 1237 and 1238 rotatably mounted on shaft 1225 serve conveyor belts 1263 and 1264 of conveyors 1163 and 1164, respectively.

With the construction shown in FIGS. 10–12, belts 1263 and 1264 of conveyors 1163 and 1164 may be driven at different speeds, through the two drive pulley shafts 1235 and 1236. In practice, the speed differential between the two belts is usually quite small. However, the speed difference for the two conveyors can be critical when slices from two loaves fed into the slicing head of the machine should be of different thicknesses. The drives for the two upper "short" conveyors 1165 and 1166 (FIG. 4) are also split. Conveyors 1163 and 1165 are always driven at the same speed, whereas conveyors 1164 and 1166 are also driven at the same speed.

The Orifice/Shear Edge Assemblies, FIGS. 13–17

Figures 13, 14:
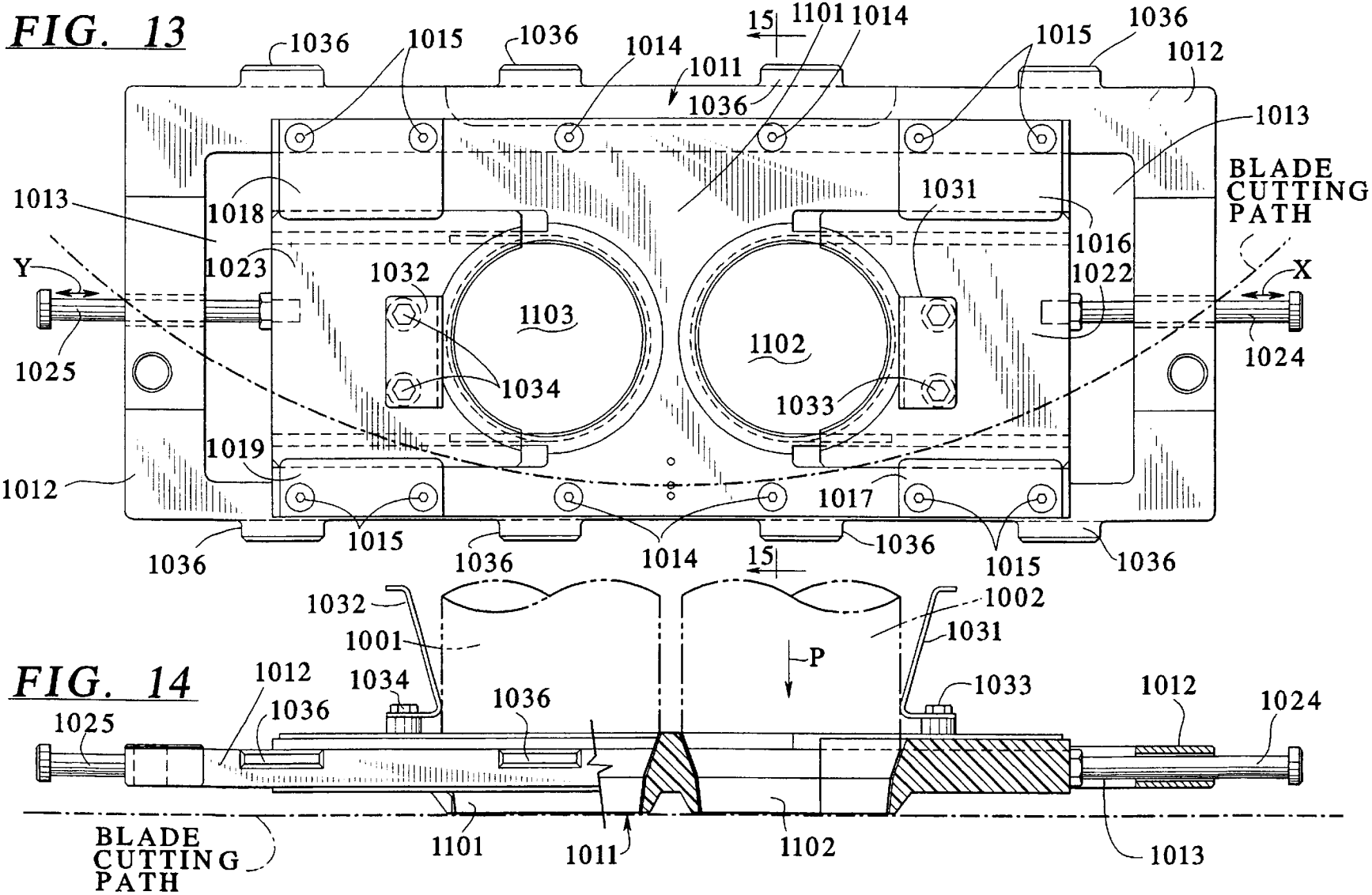
FIG. 13 is a detail front elevation view of a two-loaf shear edge and orifice member for the slicing machine of FIG. 1 as seen from the food loaf side.
FIG. 14 is a partially-sectioned plan view of the orifice member illustrated in FIG. 13.
Figure 15:
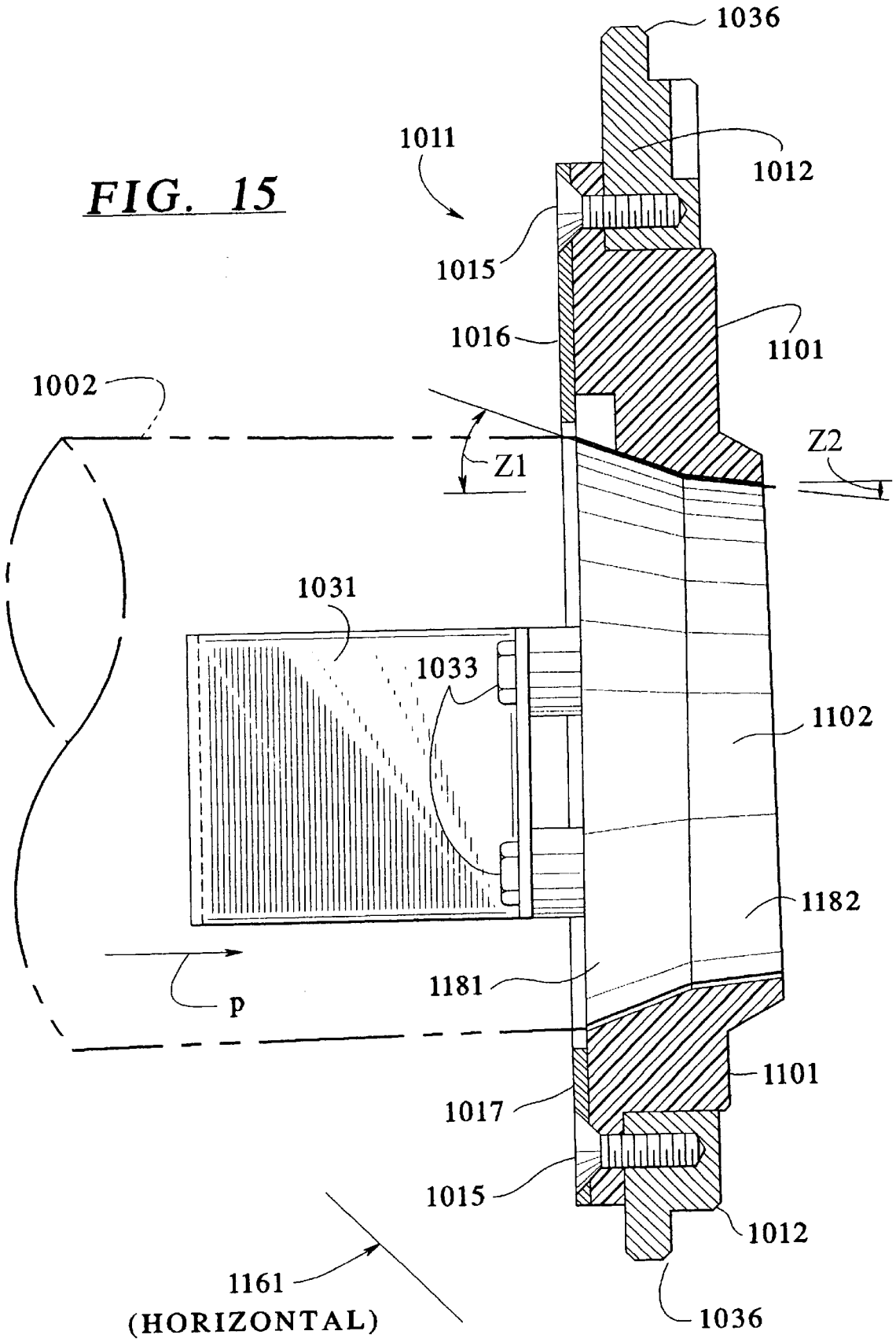
FIG. 15 is a detail sectional elevation view, on an enlarged scale, taken approximately as indicated by line 15—15 in FIG. 13.

FIGS. 13 and 14 illustrate a shear edge and orifice assembly 1011 used in slicing machine 50 when slicing two round food loaves 1001 and 1002 (FIG. 14) of approximately equal diameter; the loaves for assembly 1011 may be assumed to have a nominal diameter of less than 5.5 inches (14 cm). FIG. 13 shows the food loaf (upstream) side of assembly 1011. Assembly 1011 includes a central orifice member 1101, formed of a machinable plastic and having a far side orifice 1102 and a like near side orifice 1103, into which loaves 1001 and 1002 extend as shown in FIG. 14. The cutting path of blade 149 (FIG. 2) is delineated in each of FIGS. 13 and 14. FIG. 15 affords an enlarged sectional view of orifice 1102 and loaf 1002; the other orifice 1103 is the same as orifice 1102. A machinable plastic is used for orifice member 1101 so that the face of the orifice member can be sliced away by the cutting blade (e.g., blade 149) with continued use and will always present a smooth, planar surface at the entrance to the slicing station.

Member 1101, FIGS. 13–15, is illustrative of one member of a family of dual-opening orifice members; the size and shape of its orifices 1102 and 1103 conforms to the size and shape of the loaves (e.g., loaves 1002 and 1001, respectively) being sliced. For loaves of different sizes or shapes, a different, conforming orifice member (not illustrated) should be used. When two loaves that vary significantly from each other in cross-sectional size or shape are to be sliced simultaneously, further shear edge members having orifices matching those loaf combinations should be used.

Typically, for round food loaves such as loaves 1001 and 1002, the diametrical size of orifices 1102 and 1103 may range from two inches (five cm) to about five and one half inches (fourteen cm). Other size ranges may be employed, depending on the needs of the user of slicing machine 50. Similar size ranges may be established for food loaves of square, rectangular, or other cross-sectional configuration. Because some components in assembly 1011 (FIGS. 13–15) may have to be changed to accommodate different food loaf sizes or shapes, it is usually best to replace the entire assembly when a changeover to dual food loaves of a different size (or sizes) is made.

The shear edge/orifice assembly 1011 includes a rectangular frame 1012 having a relatively large rectangular central opening 1013. The central orifice member 1101 is mounted in opening 1013 by appropriate means such as a plurality of screws or other fasteners 1014 and 1015. At the right-hand side of assembly 1011, as seen in FIG. 13, some of the fasteners 1015 mount two guide plates 1016 and 1017 on member 1101. Similarly, at the left-hand side of assembly 1011, FIG. 13, others of the fasteners 1015 mount two guide plates 1018 and 1019 on member 1101. Guides 1016 and 1017 engage the upper and lower edges, respectively, of a slide 1022 that extends toward and defines the right-hand part of orifice 1102. Guides 1018 and 1019 contact the upper and lower edges of a slide 1023 that extends toward and forms the left-hand rim of orifice 1103. A rod 1024 secured to slide 1022 is used to adjust the slide in the direction of arrows X to modify the size of orifice 1102. Similarly, a rod 1025 affixed to slide 1023 moves that slide in the direction of arrows Y to vary the size of orifice 1103 to a limited extent.

A resilient loaf guide 1031 for loaf 1002 is mounted on slide 1022 by appropriate means such as the screws or like fasteners 1033. A like resilient loaf guide 1032 engages the side of loaf 1001; guide 1032 is mounted on slide 1023 by fasteners 1034. Frame 1012 has a plurality of projections 1036 to locate assembly 1011 quickly and accurately in the entrance to the slicing station of machine 50.

Figures 16, 17:
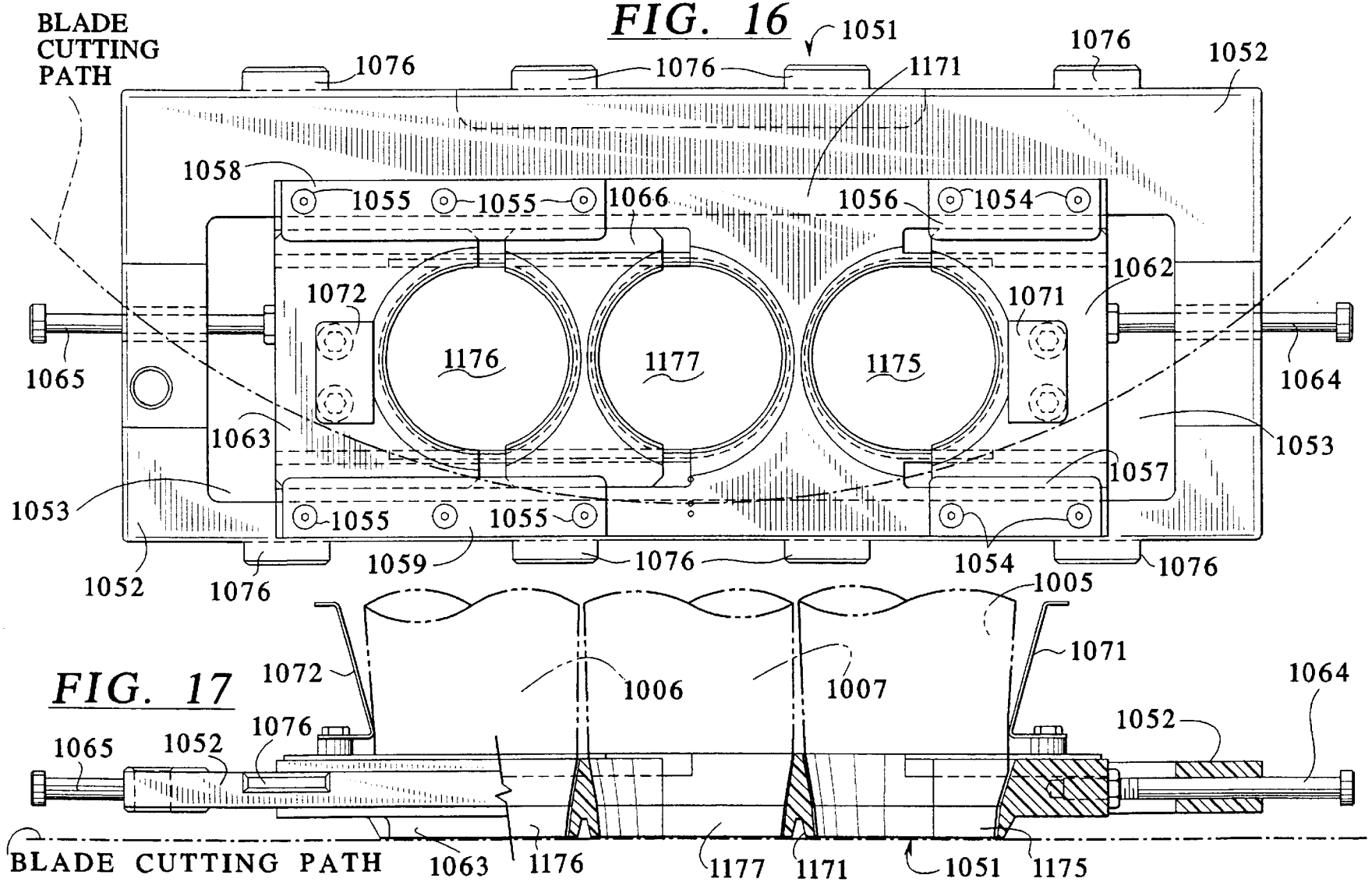
FIG. 16 is a detail front elevation view of a three-loaf orifice and shear edge member for the slicing machine of FIG. 1 as seen from the food loaf side.
FIG. 17 is a partially-sectioned plan view of the orifice member shown in FIG. 16.

FIGS. 16 and 17 illustrate a shear edge/orifice assembly 1051 used in slicing machine 50 when slicing three round food loaves 1005, 1006 and 1007 (FIG. 17) of approximately equal diameter; FIGS. 16 and 17 comprise views like those of FIGS. 13 and 14, respectively. Because the basic construction of assembly 1051 is quite similar to the previously described assembly 1011, the description can be abbreviated somewhat.

Assembly 1051 of FIGS. 16 and 17 includes a central orifice member 1171 formed of a machinable resin and having a far side orifice 1175, a near side orifice 1176, and a central orifice 1177 for loaves 1005, 1006, and 1007, respectively; see FIG. 17. Member 1171, FIGS. 16 and 17, is illustrative of one member of a family of triple-orifice members in which the sizes and shapes of the orifices (e.g., 1175–7) conform to the sizes and shapes of the loaves (e.g., 1005–1007) being sliced. As before, for loaves of different sizes or shapes, conforming orifice members (not illustrated) should be used. When three loaves of different cross-sectional sizes or shapes are sliced simultaneously, different shear edge/orifice members having orifices conforming to the different loaves should be used. Typically, for round food loaves such as loaves 1005–1007, the diametrical size range is less than four inches (ten cm). This range can be varied, within reason, to fit the requirements of the slicing machine user. Of course, as before, other orifice size ranges and shapes may be desirable for square or rectangular loaves or loaves of other cross-sectional configuration. It is ordinarily most convenient to replace the entire assembly 1051 when a changeover is made. For slicing a single round loaf (see the larger circular phantom outline in FIG. 4) the maximum diameter is about six inches (fifteen cm).

The shear edge/orifice assembly 1051 includes an open, rectangular frame 1052; the opening 1053 is centered in the frame. Two sets of screws or other fasteners 1054 and 1055 mount orifice member 1171 in frame 1052. Fasteners 1054 also serve to mount two guide plates 1056 and 1057 on the right-hand side of orifice member 1171. Similarly, fasteners 1055 serve to mount two longer guide plates 1058 and 1059 on the left-hand side of the orifice member; see FIG. 16. Guides 1056 and 1057 engage and guide the upper and lower edges, respectively, of a slide 1062 that abuts and partially defines orifice 1175. Guides 1058 and 1059 contact and guide the upper and lower edges, respectively, of another slide 1063 that abuts and partially defines orifice 1176. As in the previously described orifice assembly, there are two rods 1064 and 1065, affixed to slides 1062 and 1063 respectively, for moving the slides incrementally toward and away from orifices 1175 and 1176 to modify the orifice sizes to a limited extent.

Shear edge/orifice assembly 1051 (FIGS. 16 and 17) includes an additional slide 1066 that is engaged and guided by the elongated guides 1058 and 1059. Slide 1066 is situated between orifices 1176 and 1177 and, in part, serves to define the peripheries of both orifices. There is no rod to position slide 1066; that slide contacts adjacent sides of both of the food loaves 1006 and 1007. Whenever the portion of central food loaf 1007 entering orifice 1177 (FIG. 17) is somewhat enlarged, relative to other portions of that loaf, slide 1066 is forced to move incrementally to the left, as seen in FIGS. 16 and 17, resulting in a like movement of the portion of loaf 1006 and slide 1063 to the left against the bias afforded by rod 1065. Conversely, if the part of center loaf 1007 entering orifice 1177 is marginally undersize, slides 1066 and 1063 (and loaf 1006) move incrementally to the right.

Assembly 1051, FIGS. 16 and 17, includes a pair of resilient outer loaf guides 1071 and 1072 mounted on slides 1062 and 1063 respectively. These resilient guides function in the same way as loaf guides 1031 and 1032 of assembly 1011, FIGS. 13 and 14. As before, frame 1052 of assembly 1051 has a plurality of projections 1076 to locate the assembly, quickly and accurately, in the entrance to the machine's slicing station.

In all of the orifice assemblies illustrated by FIGS. 13–17 each orifice leading each food loaf toward the cutting path of the slicing blade has a dual taper. This can best be seen in FIG. 15. As shown therein, orifice 1102 has an entrance portion 1181 that tapers inwardly in the direction P of loaf feed at an angle Z1. Entrance portion 1181 of orifice 1102 leads into an exit portion 1182 that tapers in the same direction but at a smaller angle Z2. Both of these taper angles are quite small; typically, Z1 may be about twenty degrees and Z2 about seven degrees. The purpose of the dual taper is to improve holding a food loaf while minimizing distortion and compression of the food loaf in the orifice; a dual taper, as illustrated, functions better than a uniform taper, and is not particularly difficult to form.

SUMMARY

The loaf feed mechanism 1075 of slicing machine 50 affords positive control of the speed at which food loaves are conveyed into the slicing station of the machine; another force in moving the food loaves during slicing is derived from gravity and the weight of the food loaves themselves. The angular alignment of the upper "short" conveyors relative to food loaves fed partly by those conveyors, and the tilting movements and the limited relative movements of the upper and lower "short" conveyors, combined with their telescoping, zero back-lash drives, enable the loaf feed mechanism 1075 to compensate for variations in the loaves being sliced, without requiring continuous operator action. The dual taper orifices for the food loaves contribute materially to that compensation action.

The retraction mechanism 1270, by retracting all of the loaf feed mechanism, including the orifice/shear edge assembly, and the food loaves themselves during non-cutting intervals in operation of the slicing machine, enables use of slicing speeds not previously possible. The slicing blade never stops once slicing begins. Nevertheless, slice thickness is continuously maintained under close control, adequate to meet stringent slice weight requirements. At the same time, versatility is maximized; one, two, three, or four loaves within broad size ranges can be sliced with minimal set-up and/or changeover time required.

We claim:

1. An improvement for a continuous loaf feed mechanism for a high speed food loaf slicing machine, the slicing machine including:

a slicing station comprising a knife blade and a knife blade drive driving the blade along an arcuate cutting path;

an inclined loaf support supporting at least one food loaf for movement by gravity along a loaf path intersecting the cutting path;

two short loaf feed conveyors, the short conveyors being spaced from each other and engaging opposite sides of at least one food loaf immediately ahead of the cutting path;

and variable speed conveyor drive means for driving the two short conveyors at variable speeds to vary thickness of slices cut from the loaf by the knife blade;

the improvement comprising:

a conveyor housing, enclosing the short conveyors, the conveyor housing being located at a position immediately ahead of the cutting path; and retraction means to retract the short conveyors, the conveyor housing, and any food loaf having a portion of the loaf engaged between those short conveyors, during each non-cutting operation, to minimize cutting of irregular food loaf slices.

2. An improvement for a continuous loaf feed mechanism for a high speed food loaf slicing machine, according to claim 1, further comprising a control means having a memory means and the retraction means includes a means for recording, for the memory means, the position of the conveyor housing relative to the cutting path prior to retraction so that the conveyor housing and the short conveyors can be returned with precision when cutting is resumed.

3. An improvement for a continuous loaf feed mechanism for a high speed food loaf slicing machine, according to claim 1, in which the retraction means includes a reversible servo motor, a position encoder in the servo motor to record the position of the conveyor housing, relative to the cutting path, prior to retraction, and connection means mechanically connecting the servo motor to the conveyor housing.

4. An improvement for a high speed food loaf slicing machine comprising a slicing station including a knife blade and a knife blade drive cyclically driving the knife blade along a predetermined cutting path, and inclined loaf support means for supporting a first food loaf and a second food loaf for movement by gravity along adjacent first and second loaf paths, respectively, into the slicing station for repetitive slicing of both loaves by the knife blade in each knife blade cycle;

the improvement comprising:

a first loaf feed mechanism for advancing the first food loaf along the first loaf path at a first preselected loaf feed rate;

a second loaf feed mechanism for advancing the second food loaf along the second loaf path at a second preselected loaf feed rate;

each loaf feed mechanism including two short loaf feed conveyors and a conveyor housing for the short conveyors, the short conveyors engaging opposite sides of the associated food loaf immediately ahead of the cutting path;

means for varying the loaf feed rate of each food loaf independently of the other so that slices cut from one loaf can differ in thickness from slices cut from the other; and a retraction mechanism for retracting the short conveyors, the conveyor housing, and any food loaf having a portion of the loaf engaged between the short conveyors of the first and second loaf feed mechanisms, respectively, in a direction away from the slicing station, through a distance of no more than about one-eighth inch (0.3 cm), during each non-cutting machine operation, to minimize cutting of irregular food loaf slices.

5. An improvement for a high speed food loaf slicing machine, according to claim 4, further comprising a control means having a memory means and the retraction mechanism includes a means for recording, for the memory means, the position of the loaf feed mechanism relative to the cutting path prior to retraction so that the conveyor housing and the short conveyors can be returned with precision when cutting is resumed.

6. An improvement for a high speed food loaf slicing machine, according to claim 4, in which the retraction mechanism includes a reversible servo motor and a position encoder on the servo motor to record the position of the conveyor housing relative to the cutting path prior to retraction.

7. An improvement for a high speed food loaf slicing machine, according to claim 4, in which the distance of retraction is proportional to the thickness of the slices cut from the food loaves.

8. An improvement for a high speed food loaf slicing machine, according to claim 4, in which the retraction mechanism includes a detector for detecting and end of at least one of said food loaves.

9. An improvement for a high speed food loaf slicing machine, according to claim 8, in which the detector is a proximity switch.

10. An improvement for a high speed food loaf slicing machine according to claim 4 in which food loaves are advanced serially along both the first and second food loaf paths, and further comprising means to align two food loaves end to end on the same loaf path so that both loaves enter the slicing station simultaneously.

* * * * *